US007781973B2

(12) United States Patent
Miyake et al.

(10) Patent No.: US 7,781,973 B2
(45) **Date of Patent: *Aug. 24, 2010**

(54) PLASMA DISPLAY PANEL HAVING LAMINATED MEMBERS AND VISIBLE LIGHT REFLECTION LAYER

(75) Inventors: Tatsuya Miyake, Tokorozawa (JP); Keizo Suzuki, Kodaira (JP); Masatoshi Shiiki, Musashimurayama (JP); Choichiro Okazaki, Kodaira (JP); Tsuyoshi Fujita, Yokohama (JP); Seiichi Tsuchida, Yokosuka (JP)

(73) Assignee: Hitachi, Ltd., Tokyo (JP)

( * ) Notice: Subject to any disclaimer, the term of this patent is extended or adjusted under 35 U.S.C. 154(b) by 752 days.

This patent is subject to a terminal disclaimer.

(21) Appl. No.: 11/208,558

(22) Filed: Aug. 23, 2005

(65) Prior Publication Data

US 2007/0001602 A1 Jan. 4, 2007

(30) Foreign Application Priority Data

Jun. 29, 2005 (JP) ..... 2005-189377

(51) Int. Cl.
*H01J 17/49* (2006.01)

(52) U.S. Cl. ..... 313/587; 313/586

(58) Field of Classification Search ..... 313/582–587
See application file for complete search history.

(56) References Cited

U.S. PATENT DOCUMENTS 6,362,799 B1 3/2002 Ueoka et al.
6,670,754 B1 * 12/2003 Murai et al. ..... 313/582
2002/0167275 A1 11/2002 Bechtel et al.
2005/0062420 A1 * 3/2005 Sano et al. ..... 313/582
2006/0232206 A1 * 10/2006 Seo ..... 313/582

(Continued)

FOREIGN PATENT DOCUMENTS

EP 1 376 643 A3 5/2003

(Continued)

OTHER PUBLICATIONS

United Kingdom Combined Examination and Search Report dated Jan. 3, 2006.

(Continued)

*Primary Examiner*—Bumsuk Won
(74) *Attorney, Agent, or Firm*—Stites & Harbison, PLLC; Juan Carlos A. Marquez, Esq.

(57) ABSTRACT

A plasma display panel has plural discharge cells between two opposing first and second substrates. Each of the discharge cells includes at least one pair of electrodes for generating a discharge for display, a discharge gas and a phosphor film for emitting visible light by being excited by ultraviolet rays produced by the discharge of the discharge gas. Laminated members are dispersed in a plane within each of the discharge cells inside the first substrate from which visible light for display is emitted, and each of the laminated members includes a light absorption layer disposed on a side of the first substrate on which ambient light is incident and a light reflection layer disposed on a phosphor-film side of the laminated members. A visible-light-reflection layer is disposed on a surface of the phosphor film on a side thereof opposite from a space in which the discharge is generated.

19 Claims, 32 Drawing Sheets

U.S. PATENT DOCUMENTS

| | | | | |
|---|---|---|---|---|
| 2006/0238125 | A1* | 10/2006 | Hur et al. | 313/586 |
| 2007/0007895 | A1* | 1/2007 | Lin | 313/587 |

FOREIGN PATENT DOCUMENTS

| | | |
|---|---|---|
| JP | 02-242548 | 3/1989 |
| JP | 08-227664 | 2/1995 |
| JP | 11-185635 | 12/1997 |
| JP | 11-213892 | 1/1998 |
| JP | 11-260269 | 3/1998 |
| JP | 2000-011885 | 6/1998 |
| JP | 2000-242186 | 2/1999 |
| JP | 2001-215886 | 11/2000 |
| JP | 2004-031287 | 6/2002 |

OTHER PUBLICATIONS

Mikoshiba, Shigeo, "Up-to-date Technology for Plasma Displays", ED Research Company, Tokyo, (1966), pp. 121-133 in Japanese (English Translation of Related Portion).

Baret, G. et al., "A 640 × 480 High-Resolution Color ac Plasma Display", SID 93 Digest, (1993), pp. 173-175.

* cited by examiner

PLASMA DISPLAY PANEL HAVING LAMINATED MEMBERS AND VISIBLE LIGHT REFLECTION LAYER

CLAIM OF PRIORITY

The present application claims priority from Japanese application serial no. 2005-189377, filed on Jun. 29, 2005, the content of which is hereby incorporated by reference into this application.

BACKGROUND OF THE INVENTION

1. Field of the Invention

The present invention relates to a plasma display panel (hereinafter also referred to as a PDP) used for a flat-type TV set and others and a plasma display device employing the plasma display panel, and in particular to a structure of a plasma display panel capable of realizing the improvement of its display luminance and display contrast.

2. Description of Prior Art

The plasma display panel is used in a large-screen, small-depth, flat-screen TV set, and has improved in performance. However, its light-room display contrast, that is, a contrast as measured in a well-lighted environment (usually assumed to be a living room provided with an ambient room illumination producing 150-200 lx), is not satisfactory yet.

FIG. 2 is an exploded perspective view of part of a structure of an example of a typical plasma display panel. The plasma display panel has a structure in which front and rear substrates are attached together and a discharge gas is filled therebetween.

The front substrate includes a plurality of electrode pairs each comprised of a transparent electrode 2 and a bus electrode 3 for producing a sustain discharge (also called a display discharge) disposed on a front glass plate 1 (usually, one electrode of the electrode pair is called an X electrode, and the other electrode of the electrode pair is called a Y electrode. In FIG. 2, only one pair of the plural electrode pairs is shown). The electrode pairs are covered with a dielectric 4 and a protective film 5.

The rear substrate includes address electrodes 9 disposed on a rear glass plate 6, and the address electrodes 9 are covered with a dielectric 8. Barrier ribs 7 are disposed on the dielectric 8, and red, blue and green phosphor films 10 are disposed between the barrier ribs 7, respectively.

The front and rear substrates are aligned with each other and are sealed together such that the electrodes on the front substrate intersect those on the rear substrate at approximately right angles (in some cases, such that the electrodes on the front substrate intersect those on the rear substrate at angles other than the approximately right angles). A space between the two substrates is filled with a discharge gas, and thereby a plurality of cells are formed. A discharge is created in a desired one of the plurality of cells, by selectively applying appropriate voltages to the sustain electrode pairs on the front substrate and the address electrodes on the rear substrate. By this main discharge, vacuum ultraviolet rays are produced, emission of red, blue and green lights is generated from the respective ones of the red, blue and green phosphor films 10 excited by the produced vacuum ultraviolet rays, thereby producing a full-color display.

However, since the body color of the phosphor 10 is usually close to white, ambient light incident on the plasma display panel is reflected by the phosphor film 10, and degrades the display contrast.

Japanese Patent Application Laid-Open No. 2004-31287 Publication discloses a method of improving display contrast which realizes higher display contrast by suppressing degradation of display luminance using a striped laminated member composed of a light absorption layer and a light reflection layer. FIG. 3 is a front view of a plasma display panel of an example disclosed in this publication, and FIG. 4 is a cross-sectional view of the plasma display panel of FIG. 3 taken along line IV-IV' of FIG. 3. The laminated member 130 is composed of a light absorption layer 110 and a light reflection layer 120, and ambient light incident on the plasma display panel is absorbed by the light absorption layer 110. On the other hand, light which is incident onto the light reflection layer 120 from a phosphor film 10 is reflected back toward the phosphor film 10, then is reflected again by the phosphor film 10, and then is emitted into the outside of the plasma display panel.

FIG. 5 illustrates a phenomenon which happens in a case where an aperture ratio of a discharge cell is reduced so as to realize a higher display contrast ratio by using the above conventional technique. Light from the phosphor film 10 at the peripheral portions of one discharge cell undergoes multiple reflections between the phosphor film 10 and the light reflection layers 120. If light reflections on the surface of one of or the surfaces of both the phosphor film 10 and the light reflection layers 120 are diffuse reflections, the number of the multiple reflections increases even more. In this case, since the reflectance of the phosphor film 10 and the light reflection layers 120 is less than 100%, no small amount of the light is absorbed. Consequently, the intensity of the light emitted from the plasma display panel is reduced as the number of light reflections is increased within the discharge cells. Therefore, as the aperture ratio is reduced for the purpose of improving the display contrast in the above conventional technique, the display luminance is reduced.

Although the device has been described in connection with the so-called ac surf ace-discharge three-electrode type PDP, it is needless to say that the present invention is applicable to various types of PDPs. For example, the present invention is applicable to dc-type PDPs as disclosed in Mikoshiba, S: "Up-to-date Technology for Plasma Displays," chap. 6, ED Research Company, Tokyo, 1996, and is also applicable to vertical-discharge type PDPs as disclosed in G. Baret, et al.: 14.4: A 640×480 High-Resolution Color ac Plasma Display, SID 93 DIGEST, pp. 173-175.

In connection with the PDP of the above-explained structure, a full-color display has been explained as formed by exciting the respective primary-color phosphors to emit red, blue and green light with vacuum ultraviolet rays produced by the main discharge. However, needless to say, the present invention is not only applicable in a case where the phosphors are excited by vacuum ultraviolet rays, but is also applicable in a case where the phosphors are excited by ultraviolet rays other than the vacuum ultraviolet rays. Further, needless to say, while the PDP of the above-explained structure generates visible lights of red, blue and green by using the phosphors, the present invention is also applicable to PDPs of a structure capable of generating visible lights directly by discharges. Further, needless to say, the present invention is also applicable in a case where visible lights of colors other than red, blue and green are generated, and in a case where a visible light of a single color is generated.

SUMMARY OF THE INVENTION

It is an object of the present invention to improve display contrast of a plasma display panel and to suppress degradation in display luminance and improve luminous efficacy at the same time.

In the case of the ac surface-discharge type, since the discharge for producing a display is generated along a surface, improvement of luminance and luminous efficacy requires an increase in the discharge space. The discharge space can be made larger by increasing its aperture ratio, where the aperture ratio is defined as a ratio of an area of a window portion of the front substrate through which display-forming visible light is irradiated into the viewing space, that is, an area of an aperture, to an area of a projection of the display discharge space onto the display surface. However, an increase in the aperture ratio decreases an area usable for a black matrix which fills spaces between the apertures with black opaque material, and a problem arises in that a light-room display contrast ratio is reduced.

In the case of an ac vertical-discharge type, since the discharge for producing a display is generated between electrodes disposed on a pair of opposing substrates supplied with ac voltages, the discharge space can be expanded toward the viewing space, the discharge space can be made larger without increasing the aperture ratio, the light-room display contrast can be increased. However, in that case, the height of barrier ribs surrounding the discharge space needs to be selected to be greater, and consequently, it makes fabrication of the high barrier ribs difficult by using a process which fabricates the barrier ribs on the front or rear plate.

The following will explain the summary of the representative ones of the inventions disclosed in this specification.

(1) A plasma display panel comprising a plurality of discharge cells disposed between a pair of opposing first and second substrates, each of said plurality of discharge cells comprising at least: at least one pair of electrodes for generating a discharge for display; a discharge gas; and a phosphor film for emitting visible light by being excited by ultraviolet rays produced by said discharge of said discharge gas, wherein laminated members are dispersed in a plane within each of said plurality of discharge cells inside said first substrate from which visible light for display is emitted, and each of said laminated members comprises a light absorption layer disposed on a side of said first substrate on which ambient light is incident and a light reflection layer disposed on a phosphor-film side of said each of said laminated members, and wherein a visible-light-reflection layer is disposed on a surface of said phosphor film on a side thereof opposite from a space in which said discharge is generated.

(2) A plasma display panel according to (1), wherein said laminated members are integrally fabricated to form a unitary structure in said plane within each of said plurality of discharge cells and said unitary structure is perforated with plural openings passing light therethrough in said plane.

(3) A plasma display panel according to (1), wherein said laminated members are plural in number in said plane within said each of said discharge cells, and are disposed separately from each other in said plane.

(4) A plasma display panel according to (2) wherein said laminated members are fabricated in a pattern of one of a mesh and a ladder.

(5) A plasma display panel according to (1), wherein at least one of said phosphor film and said visible-light-reflection layer is mixed with a pigment of approximately the same color as that of said visible light emitted by said phosphor film.

(6) A plasma display device including at least a plasma display panel and a driving circuit which drives said plasma display panel, wherein said plasma display panel comprises a front substrate through which visible light for display is emitted and a plurality of discharge cells, each of said plurality of discharge cells is provided at least with electrodes for applying voltages to said each of said discharge cells, a discharge gas for generating discharge, a phosphor film which generates visible light based upon said discharge, laminated members each comprised at least of a light absorption layer and a light reflection layer, and a visible-light-reflection layer disposed on a surface of said phosphor film on a side thereof opposite from a discharge space in which said discharge is generated, wherein said front substrate defines a part of said discharge space and forms part of a hermetic sealing, wherein a viewing space is defined as a space on a side of said front substrate opposite from said discharge space, a display surface is defined as a surface obtained by expanding over an entire area of each of said plurality of discharge cells a surface of said front substrate in contact with said discharge space, a portion of said visible light emitted into said viewing space through said display surface serves as said visible light for display, wherein a BM height hd is defined as an average of distances between a bottom surface of said discharge space and discharge-space-side surfaces of said laminated members, as measured perpendicularly to said display surface, where a first plane containing said laminated members is considered, and said bottom surface of said discharge space is a plane which faces said first plane across said discharge space and which bounds said discharge space, wherein said laminated members are disposed one of (i) within said discharge space, (ii) between said discharge space and said front substrate, and (iii) within said front substrate, are each comprised of a light absorption layer disposed on a viewing-space side thereof and a light reflection layer disposed on a discharge-space side thereof, and wherein the following inequality is satisfied: $Lave/hd<5$, where a BM region is defined as a region occupied by said laminated members in said display surface, a light-transmissive region is defined as a region in said display surface through which said visible light from said discharge space is emitted into said viewing space, a length dbm-A is defined as a shortest distance between an arbitrary point A in said BM region and said light-transmissive region, and Lave is a value of said length dbm-A averaged over an entire area of said BM region with respect to said arbitrary point A.

(7) A plasma display device according to (6), wherein said laminated members are fabricated in a pattern of one of (i) isolated islands, (ii) a mesh, (iii) a ladder, and (iv) branches of a tree.

(8) A plasma display device according to (6), wherein said laminated members are disposed on or within said front substrate.

(9) A plasma display device according to (6), wherein at least one of said phosphor film and said visible-light-reflection layer is mixed with a pigment of approximately the same color as that of said visible light emitted by said phosphor film.

(10) A plasma display panel comprising a plurality of discharge cells disposed between a pair of opposing first and second substrates, each of said plurality of discharge cells comprising at least: at least one pair of electrodes for generating a discharge for display; a discharge gas; and a phosphor film for emitting visible light by being excited by ultraviolet rays produced by said discharge of said discharge gas, wherein a visible-light-reflection layer is disposed on a surface of said phosphor film on a side thereof opposite from a space in which said discharge is generated, and said visible-light-reflection layer is comprised of glass mixed with white oxide powders, and has a thickness in a range of from 10 μm to 20 μm.

(11) A plasma display panel according to (10), wherein said white oxide powders are comprised of one of titanium oxide and zinc oxide.

(12) A plasma display panel according to (10), wherein a proportion of said glass is in a range of from 40% by volume to 60% by volume of said visible-light-reflection layer.

(13) A plasma display panel according to (10), wherein a thickness of said visible-light-reflection layer overlying said visible-light-reflection layer is in a range of from 8 μm to 35 μm.

(14) A plasma display panel according to (10), wherein at least one of said phosphor film and said visible-light-reflection layer is mixed with a pigment of approximately the same color as that of said visible light emitted by said phosphor film.

(15) A plasma display panel including a plurality of discharge cells and a barrier rib layer which defines said plurality of discharge cells; each of said plurality of discharge cells comprising: two opposing electrodes disposed on inner surfaces of opposing front and rear substrates, respectively, for generating discharge between said front and rear substrates for forming a display; dielectric films for covering said two opposing electrodes at least partially; a discharge gas; and a phosphor film for generating visible light by being excited by ultraviolet rays produced by said discharge of said discharge gas, wherein said barrier rib layer is fabricated in a form of a sheet separate from said front and rear substrates, is provided with a plurality of openings each of which forms a discharge space in each of said plurality of discharge cells, with walls of said plurality of openings being coated with said phosphor film, and is sandwiched between said front and rear substrates, wherein a relationship of $0.1 \leqq (S1-S2)/S1 \leqq 0.4$ is satisfied, where S1 is an area of a projection of a space occupied by one of said plurality of discharge cells onto said front substrate, S1–S2 is an area of a window portion of said front substrate through which the visible light is irradiated from said one of said plurality of discharge cells into an outside of said front substrate, wherein relationships of $100\ \text{Torr}\times\text{mm} \leqq pd \leqq 400\ \text{Torr}\times\text{mm}$ and $0.2\ \text{mm} \leqq d$ are satisfied, where p is a pressure of said discharge gas, and d is a distance between said two opposing electrodes, and wherein a visible-light-reflection layer is disposed on a surface of said phosphor film on a side thereof opposite from said discharge space in which said discharge is generated.

(16) A plasma display panel according to (15), wherein said two opposing electrodes have applied therebetween a voltage of an effective value equal to or smaller than 300 V for sustaining said discharge for forming a display.

(17) A plasma display panel according to (15), wherein said discharge gas contains a xenon gas, and a xenon proportion aXe in said discharge gas is in a range of from 0.12 to 0.3, where said xenon proportion $aXe = nXe/ng$, ng is a volume particle (atom or molecule) density of said discharge gas, and nXe is a volume particle density of said Xe gas.

(18) A video display system employing said plasma display panel according to (15).

(19) A plasma display panel according to (15), wherein at least one of said phosphor film and said visible-light-reflection layer is mixed with a pigment of approximately the same color as that of said visible light emitted by said phosphor film.

The structures in accordance with the present invention are capable of realizing a high-contrast plasma display panel with degradation in display luminance being suppressed.

BRIEF DESCRIPTION OF THE DRAWINGS

In the accompanying drawings, in which like reference numerals designate similar components throughout the figures, and in which:

FIG. 8(*b*) is a front view of a plasma display panel in accordance with an example of the present invention;

FIG. 8(*c*) is a front view of a plasma display panel in accordance with an example of the present invention;

FIG. 8(*d*) is a front view of a plasma display panel in accordance with an example of the present invention;

FIG. 8(*e*) is a front view of a plasma display panel in accordance with an example of the present invention;

FIG. 9(*b*) is a front view of still another structure of a plasma display panel to which the present invention is applicable;

FIG. 9(*c*) is a front view of still another structure of a plasma display panel to which the present invention is applicable;

FIG. 9(*d*) is a cross-sectional view of still another structure of a plasma display panel to which the present invention is applicable;

FIG. 9(*e*) is a cross-sectional view of still another structure of a plasma display panel to which the present invention is applicable;

FIG. 13(*b*) is a front view of a plasma display panel for explaining a light-absorbing area in the light-emissive area of FIG. 13(*a*);

FIG. 17(*b*) is a graph showing relationships between aperture ratios and figures of merit;

FIG. 25(*b*) is a graph showing a relationship between the relative display luminance and the thickness of the phosphor films;

FIG. 26(*b*) is an exploded perspective view of part of a PDP in accordance with another example of the present invention;

FIG. 28(*b*) is a graph showing a relationship of the ultraviolet ray production efficiency and the sustain voltage Vs versus the Xe proportion;

FIG. 28(*c*) is a graph showing a relationship of relative display luminance and display contrast versus the aperture ratio in the prior-art ac surface-discharge type plasma display panel, and a relationship of the display contrast versus the aperture ratio with the product pd as a parameter in the ac vertical-discharge type plasma display panel in accordance with the present invention;

DETAILED DESCRIPTION OF THE PREFERRED EMBODIMENTS

Figure 1:
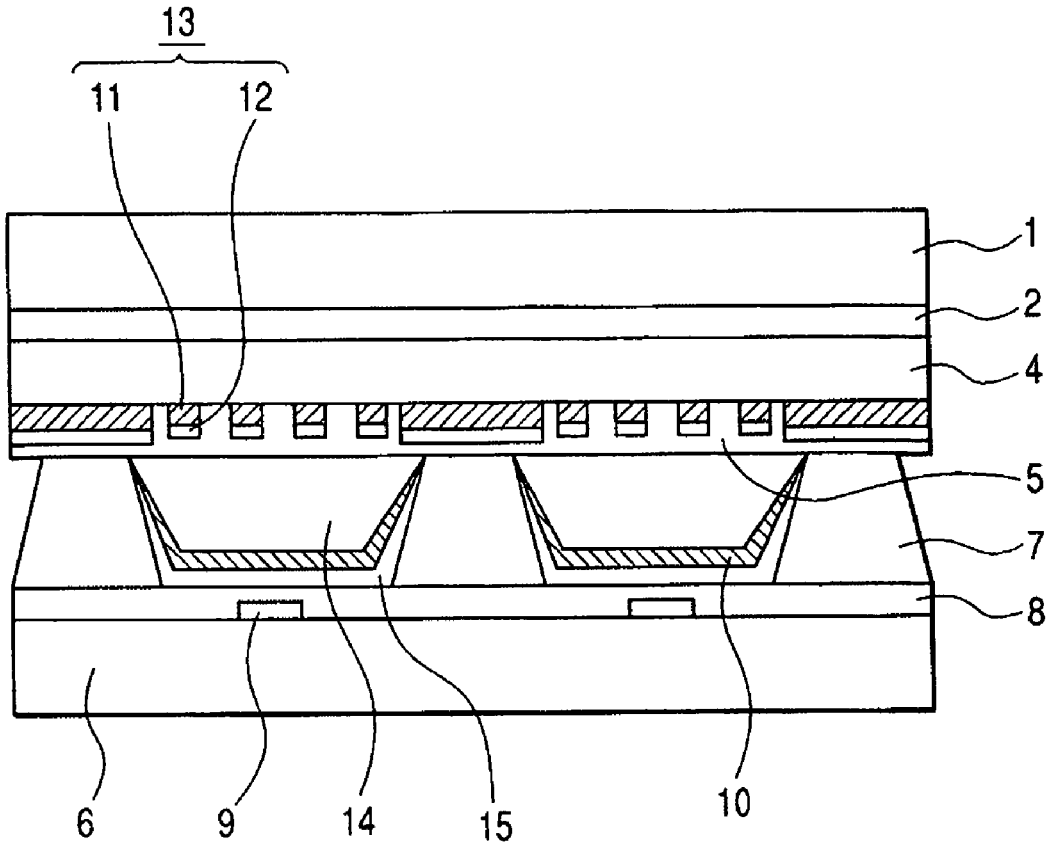
FIG. 1 schematically illustrates a plasma display panel in accordance with the present invention, and is a cross-sectional view of a plasma display panel in accordance with the present invention of FIG. 6 taken along line I-I' of FIG. 6.

An embodiment in accordance with the present invention will be explained in detail with reference to FIGS. 1, 6, 7 and 8(*a*)-8(*e*). The same reference numerals or symbols designate functionally similar parts or portions throughout the figures, and repetition of their explanation is omitted.

Figure 6:
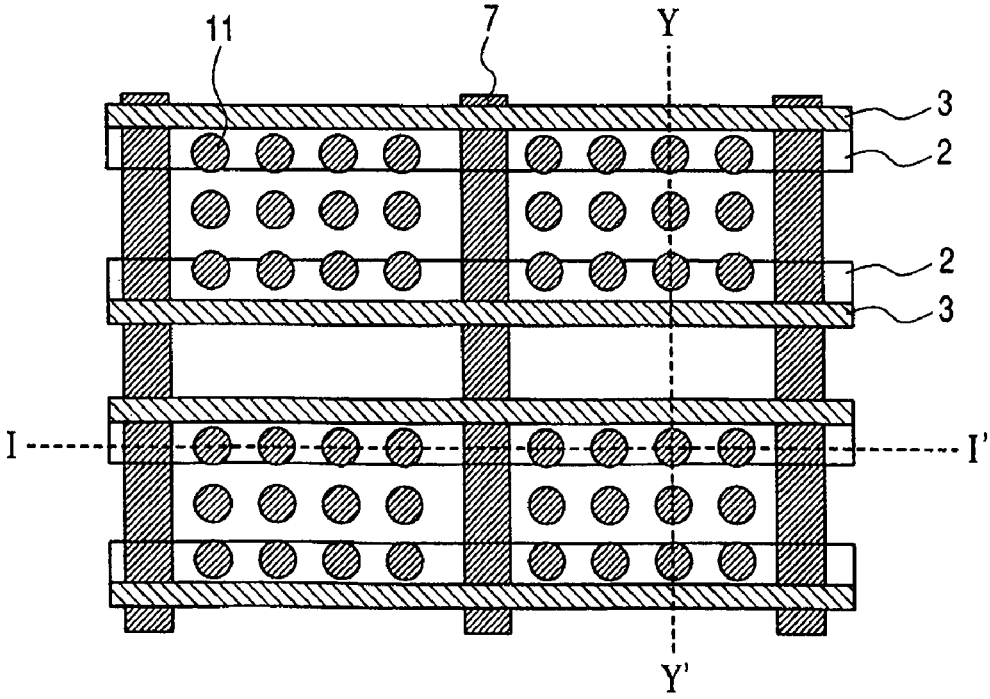
FIG. 6 is a schematic front view of a plasma display panel in accordance with the present invention.

FIG. 6 is a front view of an example of a plasma display panel in accordance with the present embodiment, and FIG. 1 is a cross-sectional view of the plasma display panel of FIG. 6 taken along line I-I' of FIG. 6.

Figure 2:
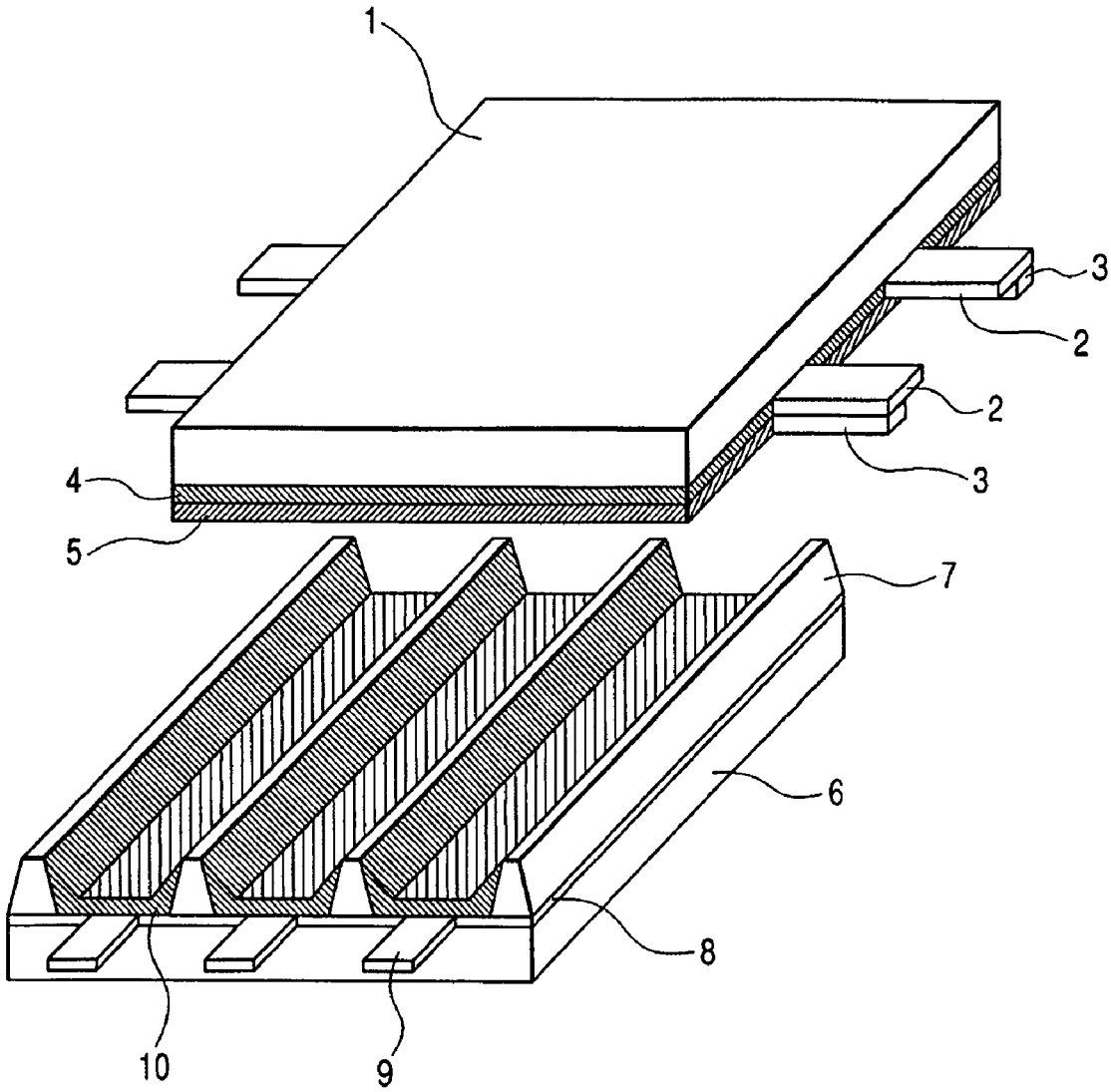
FIG. 2 is an exploded perspective view illustrating a structure of a plasma display panel.
Figure 3:
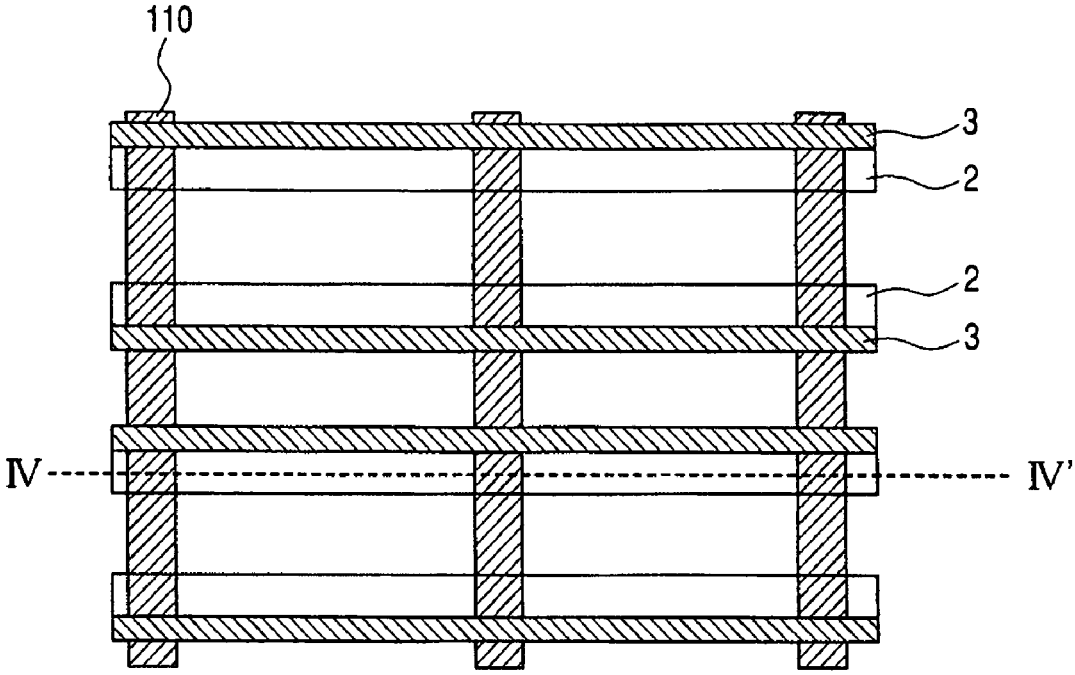
FIG. 3 is a front view of a conventional plasma display panel.
Figure 4:
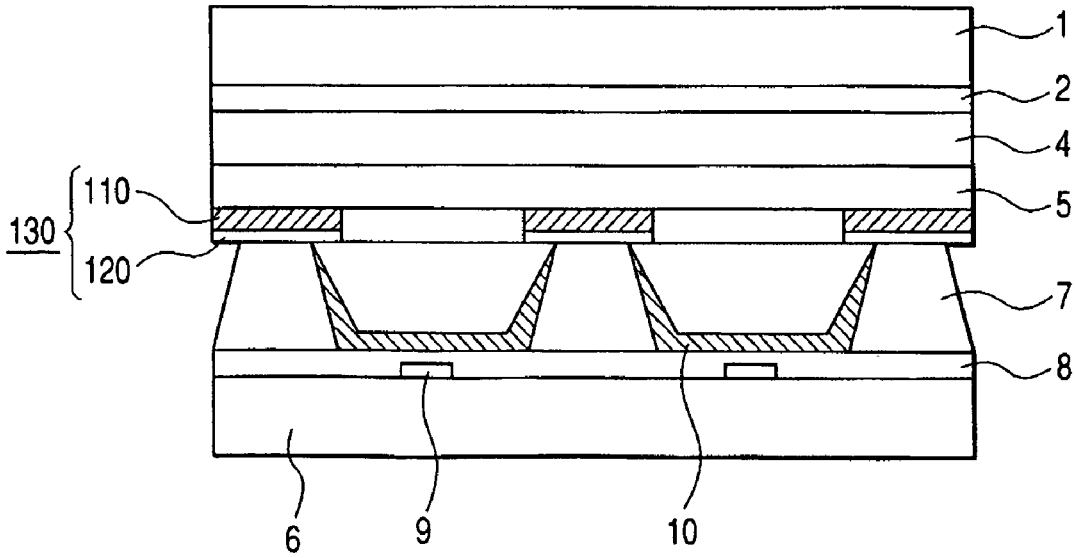
FIG. 4 is a cross-sectional view of the conventional plasma display panel of FIG. 3 taken along line IV-IV' of FIG. 3.

The basic structure of the plasma display panel in accordance with the present embodiment is similar to that explained already in connection with FIG. 2. The plasma display panel of this embodiment has a structure in which front and rear substrates are attached together and a discharge gas is filled therebetween. The front substrate includes a plurality of electrode pairs each comprised of a transparent electrode 2 and a bus electrode 3 for producing a sustain discharge disposed on a front glass plate 1. The electrode pairs are covered with a dielectric 4 and a protective film 5. The rear substrate includes address electrodes 9 disposed on a rear glass plate 6, and the address electrodes 9 are covered with a dielectric 8. Barrier ribs 7 are disposed on the dielectric 8, and red, blue and green phosphor films 10 and underlying reflection layers 15 are disposed between the barrier ribs 7, respectively. Further, the reflectance of the display panel can be decreased without decreasing display luminance, by adding red, blue and green pigments to the red phosphor films 10 and the underlying reflection layers 15 in red discharge cells, the blue phosphor films 10 and the underlying reflection layers 15 in blue discharge cells and the green phosphor films 10 and the underlying reflection layers 15 in green discharge cells, respectively.

The front and rear substrates are aligned with each other and are sealed together such that the electrodes on the front substrate intersect those on the rear substrate at right angles A space between the two substrates is filled with a discharge gas, and thereby a plurality of cells are formed. A discharge is created in a desired one of the plurality of cells, by selectively applying appropriate voltages to the sustain electrode pairs on the front substrate and the address electrodes on the rear substrate. By this main discharge, vacuum ultraviolet rays are produced, emission of red, blue and green lights is generated from the respective ones of the red, blue and green phosphor films 10 excited by the produced vacuum ultraviolet rays, thereby producing a full-color display.

This embodiment has features that the plasma display panel is provided with laminated members each comprising at least a light absorption layer disposed on a side of the plasma display panel on which ambient light is incident and a light reflection layer disposed on a side of the plasma display panel facing toward a discharge space of the plasma display panel, and that the laminated members are dispersed in a plane parallel with the front substrate within each of the discharge cells, and that plasma display panel is also provided with the reflection layers 15 underlying the phosphor films 10.

First, the laminated member and a display surface from which visible light for display is emitted will be explained. Here consider one discharge cell. A discharge space is defined as a space in which a discharge for an image display is generated. A display surface is defined as a surface obtained by expanding over the entire cell an area where the laminated members are formed, or is defined as a surface obtained by expanding over the entire cell an area of the front substrate in contact with the discharge space. The thus-defined display surface is usually in parallel with the surface of the front glass plate 1. A viewing space is defined as a space into which the visible light for display is projected through the display surface. A discharge-space side is defined as a side of the display surface where the discharge space is located, and a viewing space side is defined as a side of the display surface where the viewing space is located. The above-mentioned phrase "a laminated member comprising at least a light absorption layer and a light reflection layer" means that at least a light absorption layer and a light reflection layer are laminated in a direction perpendicular to the display surface, and is intended here to include a laminated member comprising a light absorption layer, a light reflection layer and another layer exhibiting properties other than light absorption and light reflection and interposed between the light absorption layer and the light reflection layer, or laminated on the outside surface of the laminate of the light absorption layer and the light reflection layer.

As shown in FIG. 6 which is a front view of an example of a plasma display panel in accordance with the present embodiment and FIG. 1 which is a cross-sectional view of the plasma display panel of FIG. 6 taken along line I-I' of FIG. 6, the laminated members (hereinafter called the laminated members BM (Black Matrix) or called simply BM or the black matrix) 13 is formed by laminating together a light absorption layer 11 disposed on a side of the plasma display panel on which ambient light is incident and a light reflection layer 12 disposed on a side of the plasma display panel facing toward a discharge space 14, a phosphor-film-10 side, of the plasma display panel. That is to say, the light absorption layers 11 are disposed on a viewing space side and the light reflection layers 12 are disposed on a discharge-cell-14 side (the phosphor-film-10 side). Further the plural laminated members 13 are dispersed in a plane parallel with the front substrate within each of the discharge cells.

Figure 7:
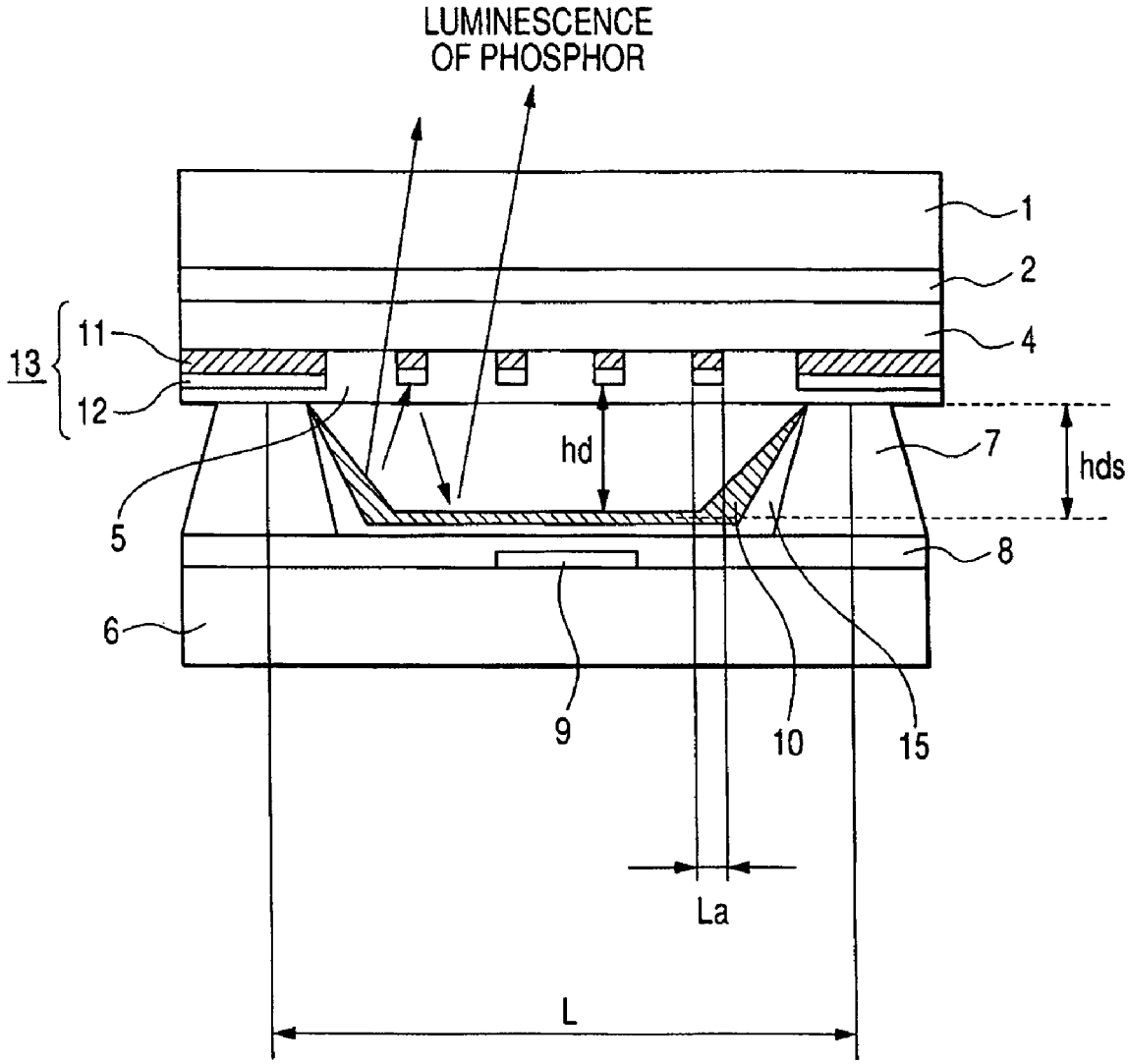
FIG. 7 is a cross-sectional view of a plasma display panel in accordance with the present invention of FIG. 6 taken along line I-I' of FIG. 6 for explaining reflection of light emitted from a phosphor film.
Figure 8A:
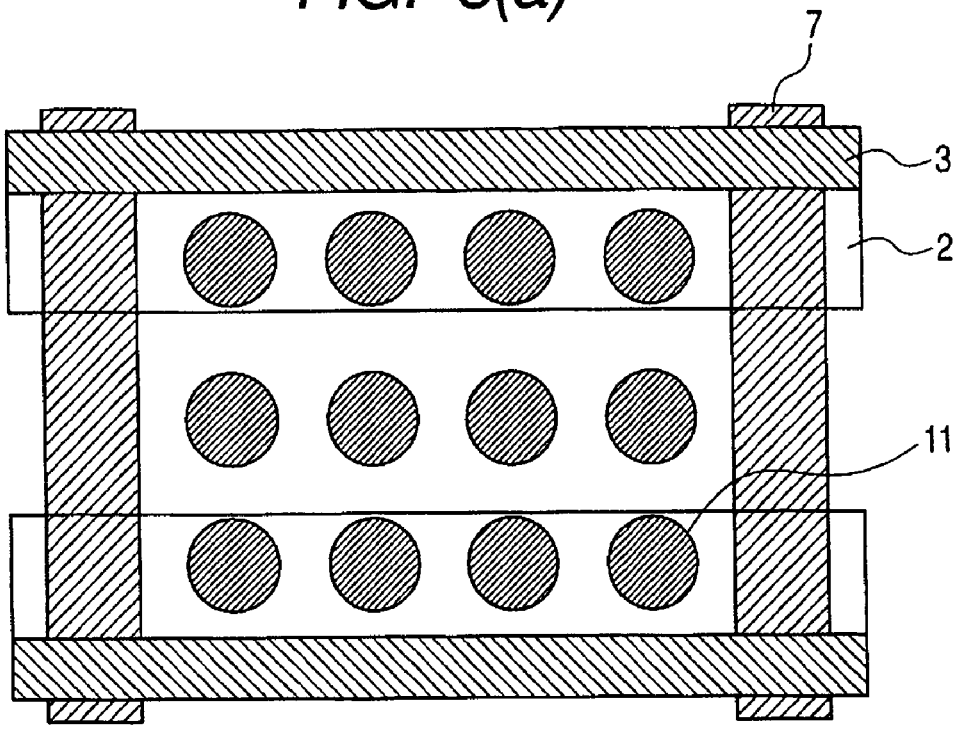
FIG. 8(*a*) is a front view of a plasma display panel in accordance with an example of the present invention.
Figure 8B:
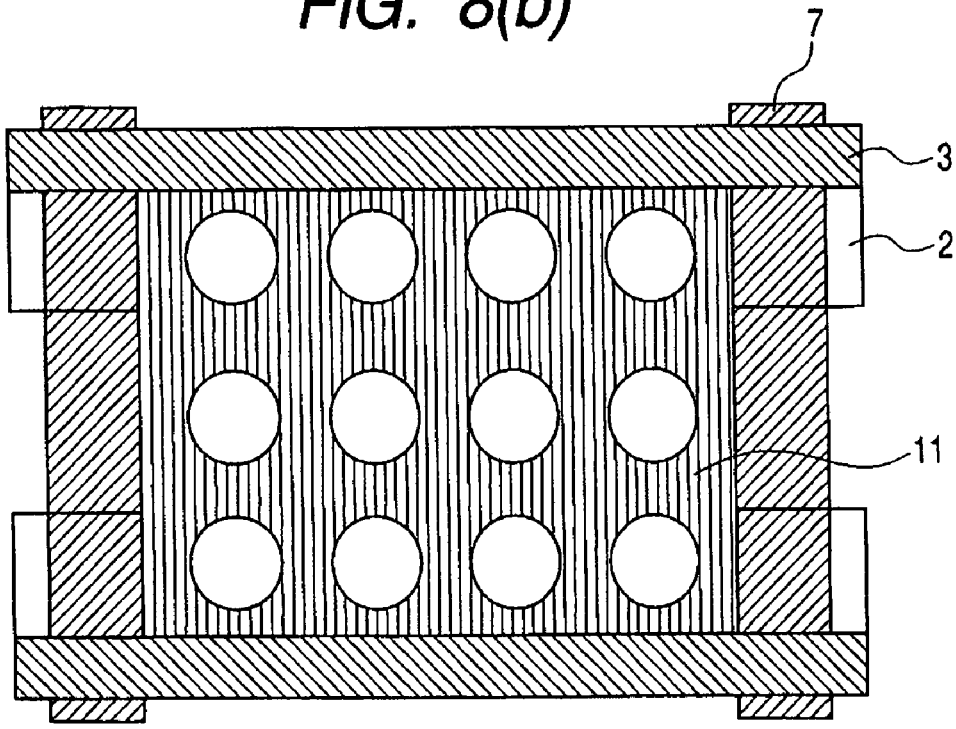
Figure 8C:
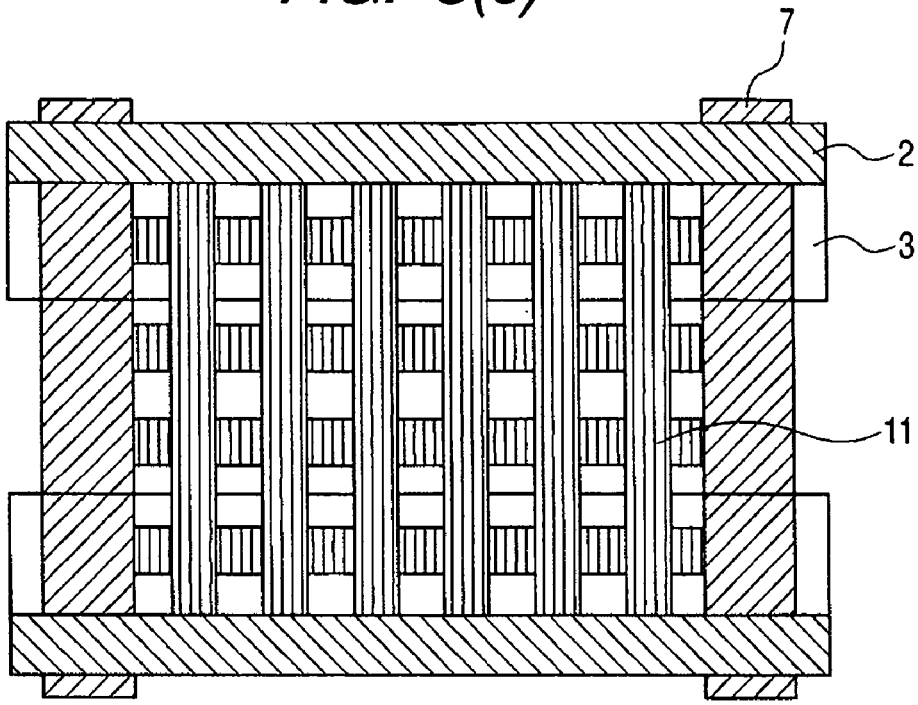
Figure 8D:
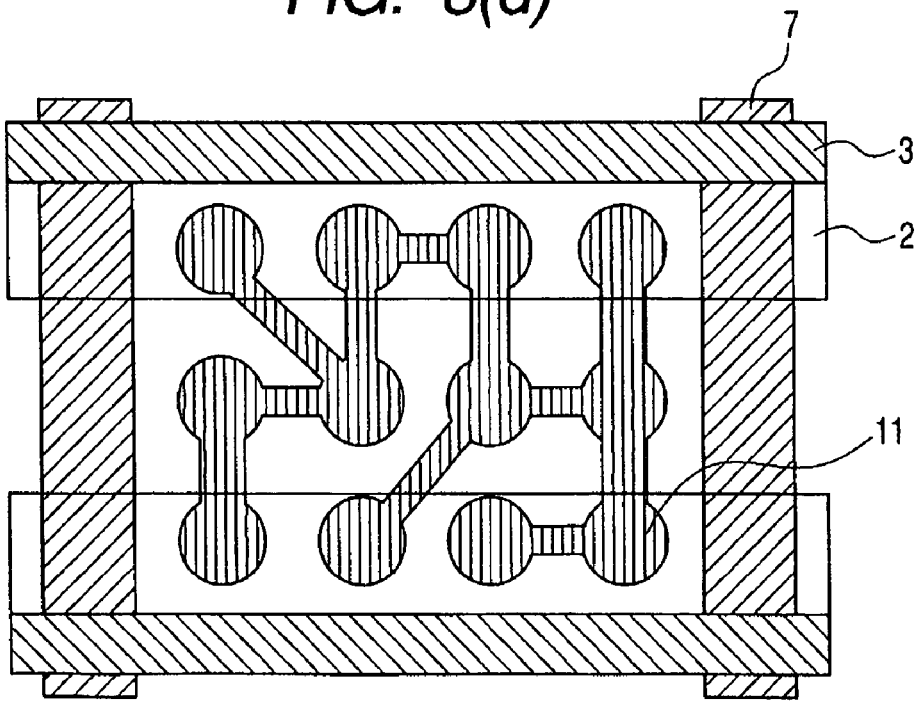
Figure 8E:
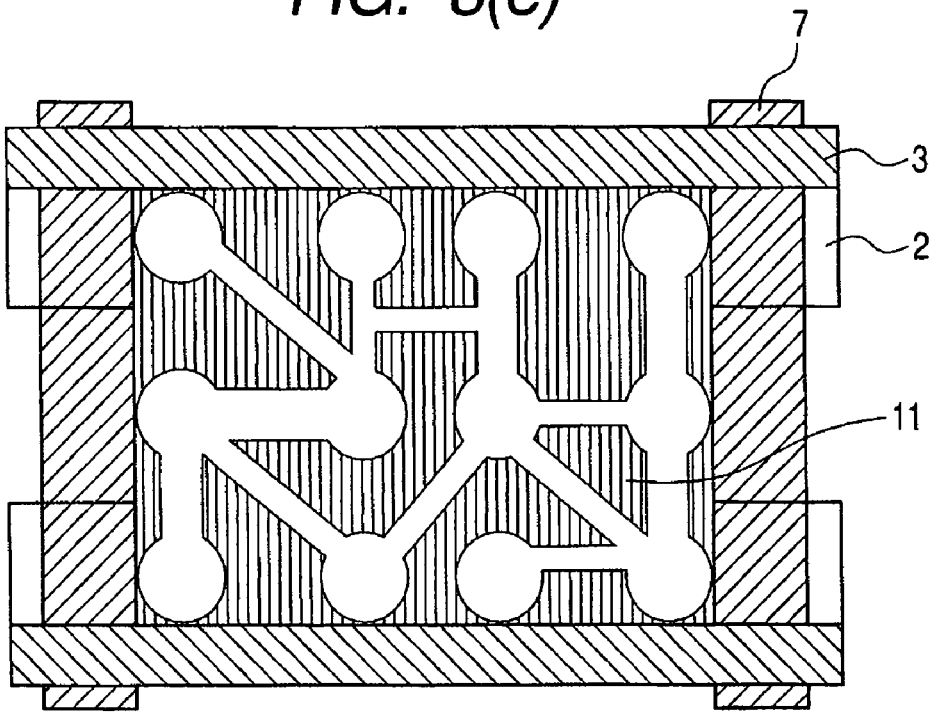
Figure 9A:
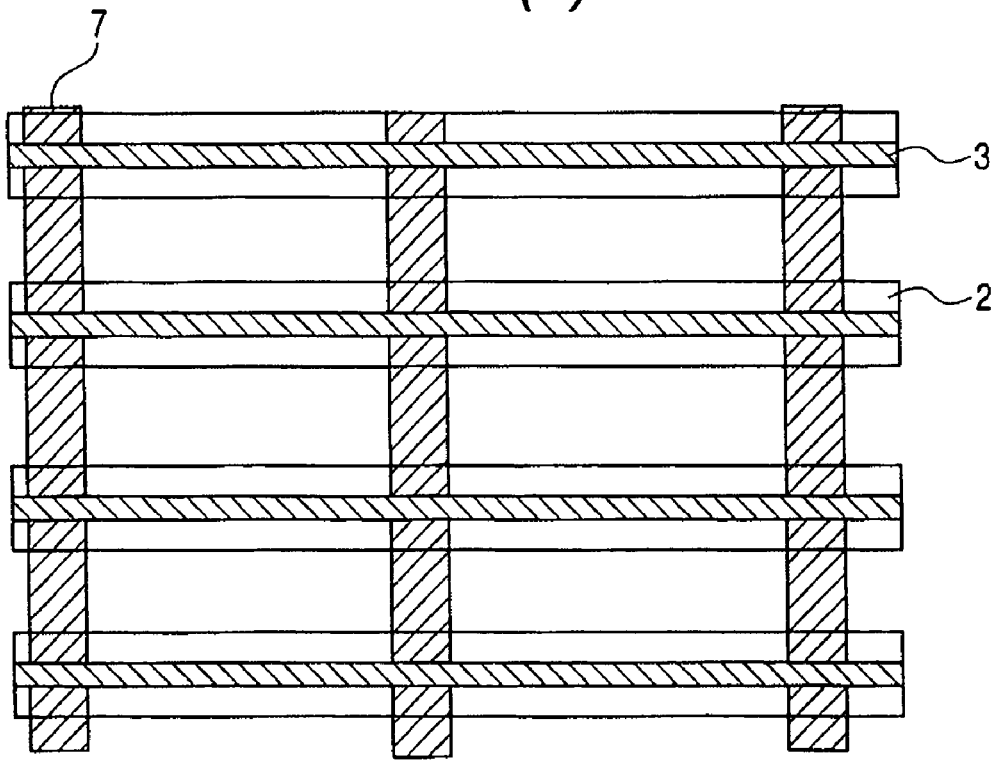
FIG. 9(*a*) is a front view of another structure of a plasma display panel to which the present invention is applicable.
Figure 9B:
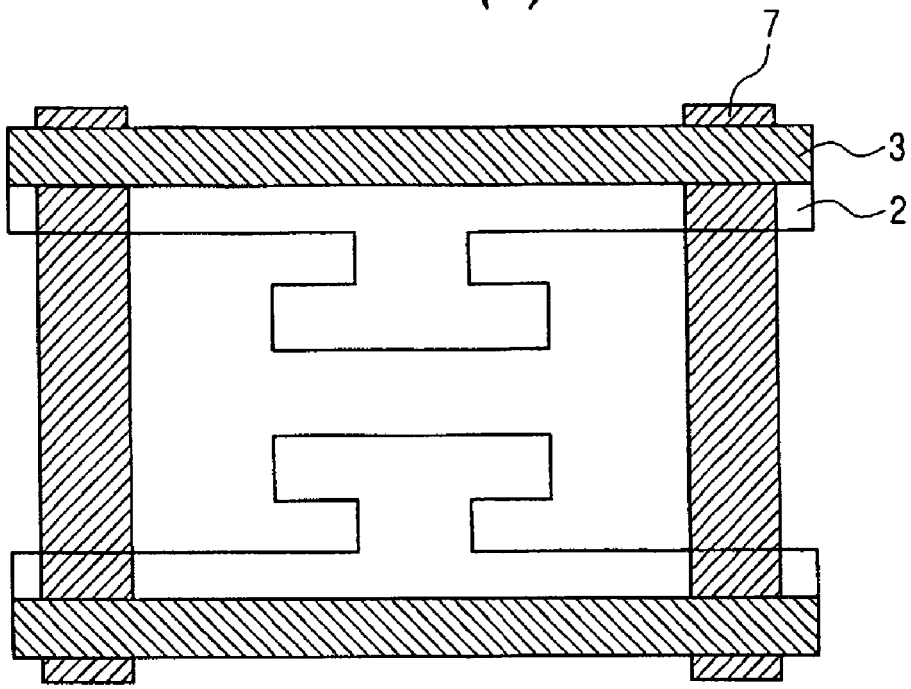
Figure 9C:
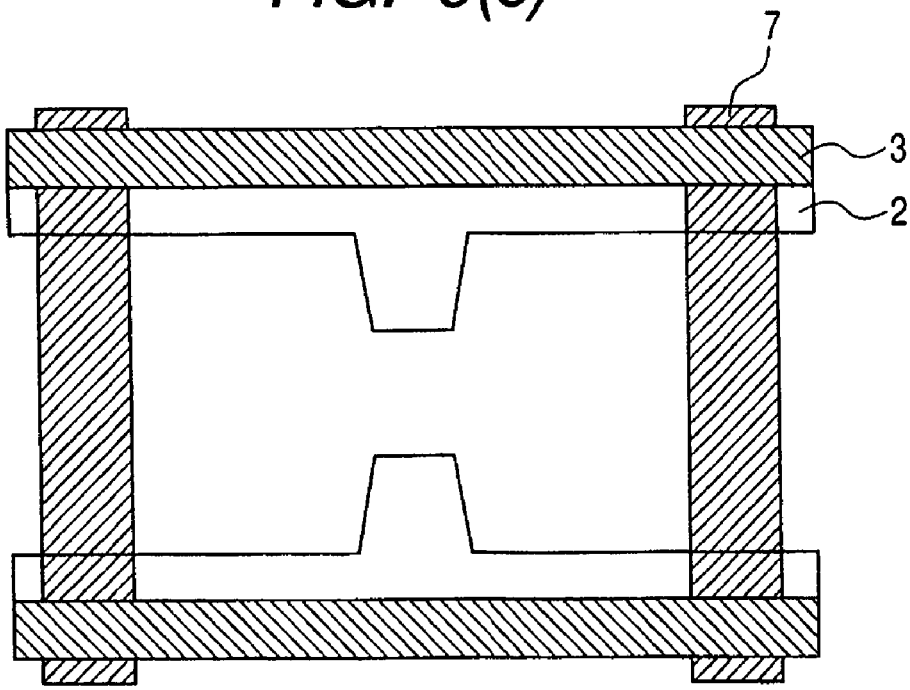
Figure 9D:
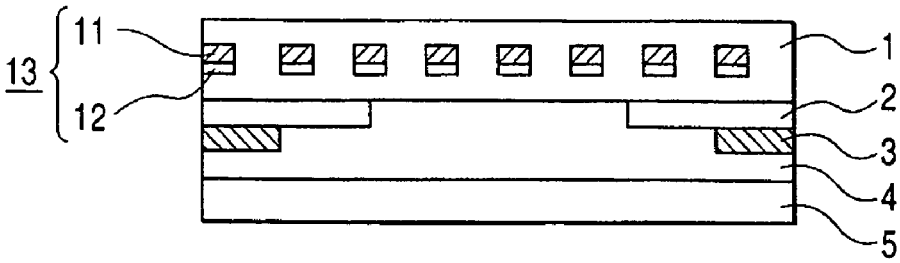
Figure 9E:
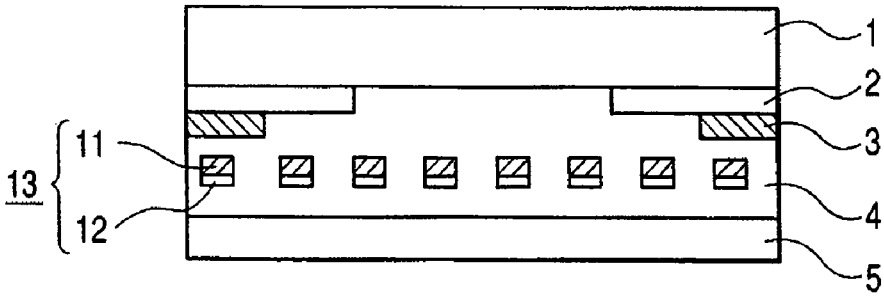

That is to say, in the present embodiment, the laminated members 13 each comprised of the light absorption layer 11 and the light reflection layer 12 are dispersed in a plane parallel with the front substrate within each of the discharge cells with gaps (or opening as described later) interposed therebetween. Therefore, a portion of light from the phosphor film 10 and its underlying reflection layer 15 at the peripheral portions of one discharge cell undergoes multiple reflections between the light reflection layers 12 of the laminated members 13 and the phosphor film 10 and its underlying reflection layer 15, and thereafter is emitted to the outside of the plasma display panel. As shown in FIG. 7, since the laminated members 13 are dispersed with gaps interposed therebetween, the light from the phosphor film 10 and its underlying reflection layer 15 is emitted through the gaps to the outside of the plasma display panel after undergoing a reduced number of multiple reflections.

Figure 5:
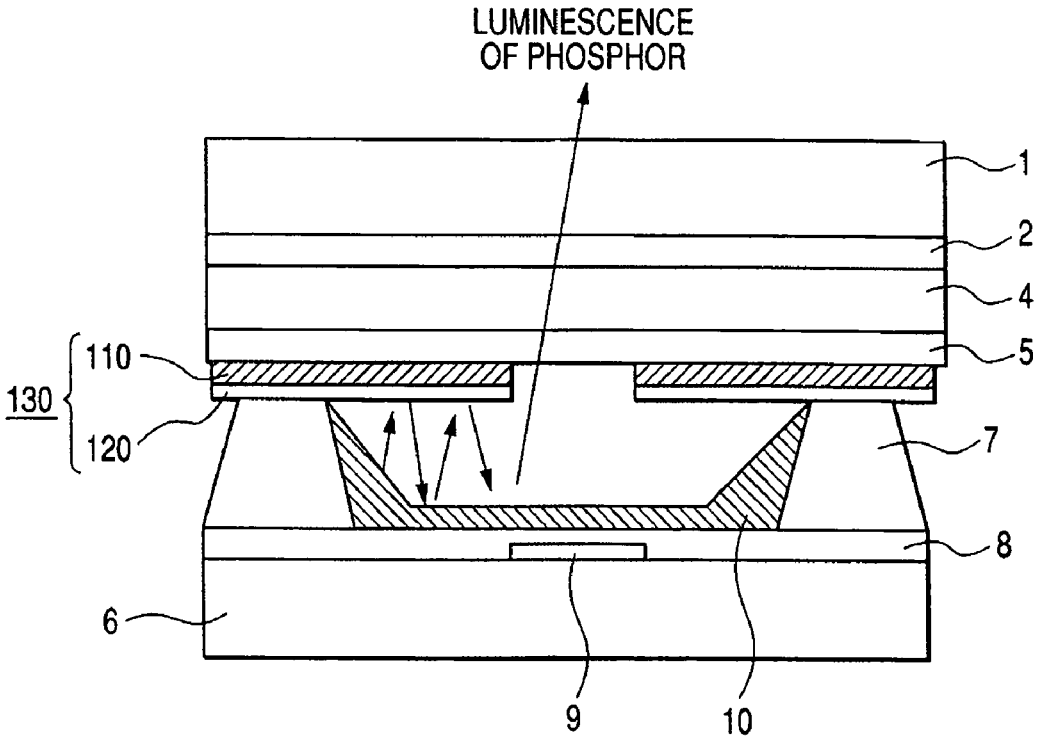
FIG. 5 is a cross-sectional view of the conventional plasma display panel of FIG. 3 taken along line IV-IV' of FIG. 3 for explaining reflection of light emitted from a phosphor film.

Consequently, compared with the case of the conventional technique explained in connection with FIG. 5, the present embodiment reduces the number of times each light from the phosphor film 10 and its underlying reflection layer 15 is reflected. Therefore, attenuation of light is reduced, and the degradation of display luminance can be suppressed. Further, the area occupied by the light absorption layer 11 within each of the discharge cells can be selected so as to obtain the required display contrast.

The following will explain an example of a method of determining the size of the laminated member 13. In FIGS. 6 and 7, the size La of the laminated member 13 is defined as follows. Consider a cross section along a given line on a front view of a plasma display panel shown in FIG. 6, and by way of example, here consider a cross section shown in FIG. 7, which is a cross section taken along line I-I' of FIG. 6. The size La of the laminated member 13 is defined as the smallest length of the laminated member 13 in the cross section of FIG. 7. The cross section to be considered can be taken along a line extending in any directions in the display surface of the plasma display panel, other than the line I-I'. In this embodiment, it is desirable that the size La of the laminated member 13 and the discharge cell size L (see FIG. 7) are selected to satisfy the following inequality in at least one cross section of the plasma display panel.

$$0<(La/L)\leqq 0.5$$

The reason is that it is preferable to increase the number of the laminated members disposed within each of the discharge cells by making the laminated members as small as possible.

Dispersion of the laminated members 13 comprised of the light absorption layer 11 and the light reflection layer 12 can be realized by the following ways, for example: Plural laminated members 13 may be dispersed in a pattern of isolated islands as illustrated in FIG. 8(*a*); the laminated members 13 may be integrally fabricated to form a unitary structure perforated with plural openings as illustrated in FIG. 8(*b*); the laminated members 13 may be integrally fabricated to form a unitary mesh-shaped structure perforated with plural square or rectangular openings as illustrated in FIG. 8(*c*); the laminated members 13 may be formed in a pattern of branches of a tree as illustrated in FIG. 8(*d*); the laminated members 13 may be integrally fabricated to form a unitary structure perforated with an opening of a pattern of branches of a tree as illustrated in FIG. 8(*e*); or the laminated members 13 may be formed in a pattern of a ladder.

In the following, the light absorption layer 11 and the light reflection layer 12 will be discussed. Consider a case where visible light falls on a layer and a portion of the visible light is absorbed. An absorption coefficient is defined as a ratio of the absorbed energy of the visible light to all the energy of the incident visible light. A layer is called a light absorption layer which has an absorption coefficient higher than that of a common material. Usually the absorption coefficient of the light absorption layer is equal to or higher than 0.5, and therefore, to obtain the pronounced advantages of the present invention, it is preferable to select the absorption coefficient of the light absorption layer to be 0.7 or more, 0.9 or more, or 0.95 or more as required.

Next, consider a case where visible light falls on a surface of a layer and a portion of the visible light is reflected. The mode of the light reflection may be a specular reflection or a diffuse reflection.

A reflectance is defined as a ratio of the reflected energy of the visible light to all the energy of the incident visible light. A layer is called alight reflection layer which has a reflectance higher than that of a common material. Usually the reflectance of the light reflection layer is equal to or higher than 0.5, and therefore, to obtain the pronounced advantages of the present invention, it is preferable to select the reflectance of the light reflection layer to be 0.7 or more, 0.9 or more, or 0.95 or more as required.

The light absorption layer 11 may be made of metals such as Cr or the like, or oxides such as chromium oxide, manganese dioxide, copper oxide or the like. The light reflection layer 12 and the reflection layer 15 underlying the phosphor films may be made of metals such as Al, Ag, Au or the like, or oxides such as titanium oxide, aluminum oxide, silicon dioxide, tantalum oxide or the like. The laminated member 13 comprised of the light absorption layer 11 and the light reflection layer 12 may be fabricated by screen printing, a method by using a dispenser, or a photolithography.

While the reflection layer 15 is employed in the above embodiments, a member supporting the phosphor films, for example, ribs themselves, can be configured to substitute the reflection layer 15 to visible light.

By the way, application of the present invention is not limited to the structure of the plasma display panel illustrated as an example in FIG. 2, but is applicable to a structure of a plasma display panel which has transparent electrode regions 2 disposed on both sides of each of the bus electrodes 3 as shown in a front view in FIG. 9(*a*), and is also applicable to structures of plasma display panels employing electrodes 2 provided with projections as shown in FIGS. 9(*b*) and 9(*c*), respectively.

Further, the laminated members 13 may be disposed within the front glass plate 1 as shown in FIG. 9(*d*), or may be disposed within the layer of the dielectric 4 as shown in FIG. 9(*e*).

The laminated members 13 of the present embodiment are disposed within the above-explained discharge spaces, between the discharge spaces and the front substrate, or within the front substrate. Especially, to simplify the structure of the plasma display panel, it is desirable to dispose the laminated members within the front substrate. Especially, when the laminated members 13 are embedded within the front glass plate 1 in advance as shown in FIG. 9(*d*), the manufacturing process for fabrication of the laminated members 13 is simplified and the practical value of this structure is great. Further, the laminated members 13 may be embedded within the layer of the dielectric 4 which covers the electrode pairs for sustain discharge as shown in FIG. 9(*e*). In this case, the laminated members 13 can be fabricated in a process step separate from that of fabricating the electrodes, and the manufacturing process can be made easier.

Further, in a case where the dielectric 4 is fabricated by using a material in the form of a sheet fabricated beforehand, the laminated members 13 can be embedded within the material in the form of a sheet beforehand, and this can make the manufacturing step more low-cost and more highly reliable. In this case, plural sheet-like materials may be used, the laminated members 13 can be formed on one of the plural sheet-like materials, and the plural sheet-like materials can be attached together to form one sheet-like material.

Figure 10:
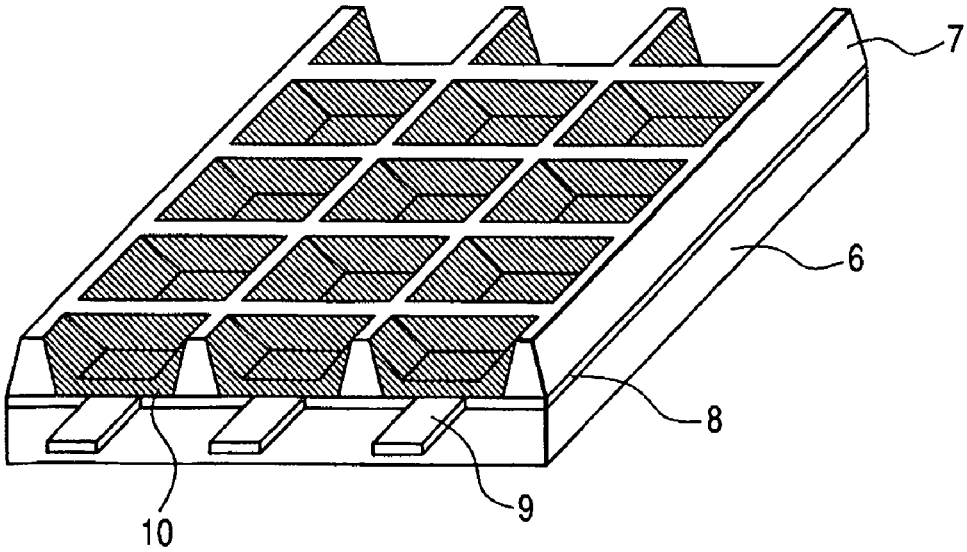
FIG. 10 is a perspective view of still another structure of a plasma display panel to which the present invention is applicable.

Further, in a case where the electrode pairs for sustain discharge (hereinafter called the sustain-discharge electrode pairs) are in the form of a letter T as shown in FIG. 9(*b*), or are provided with projections as shown in FIG. 9(*c*), when the T-shaped portions or the projections are made of the laminated members 13 (or portions of the laminated members 13), this configuration provides the great practical value. The reason is that the width of the T-shaped portions or the projections is narrow, therefore Lave which will be explained later becomes small, and the dimensional ratio Lave/hd can be made small easily. Further, the present invention is also applicable to a structure of a plasma display panel employing barrier ribs 7 in the form of a grid as shown in FIG. 10.

COMPARATIVE EXAMPLES

Figure 11:
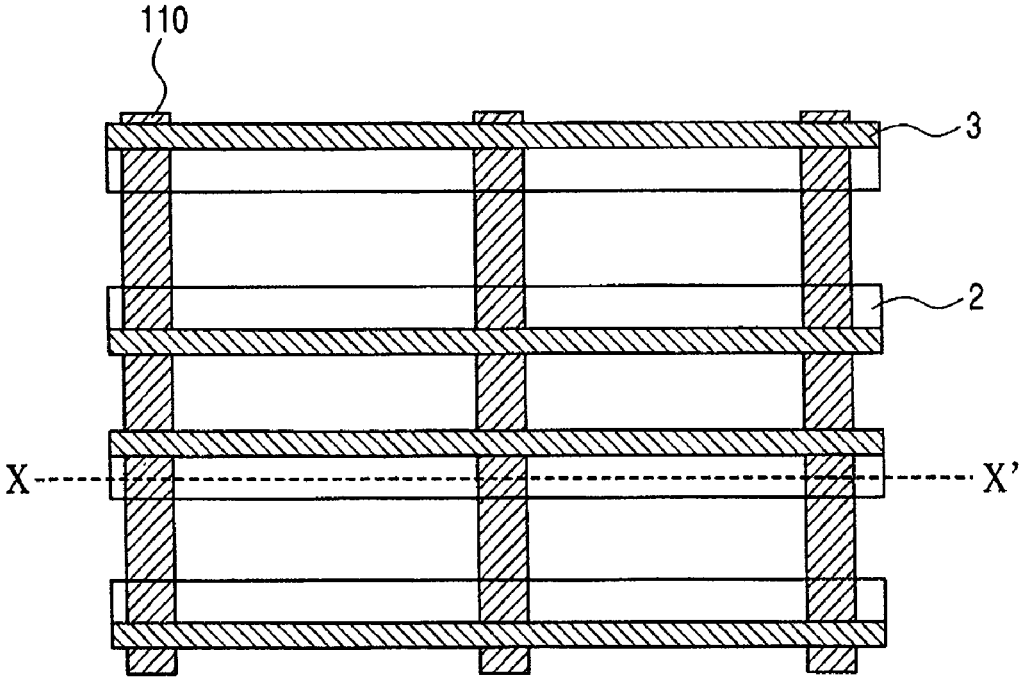
FIG. 11 is a front view of a structure for explaining a plasma display panel serving as a comparative example.
Figure 12:
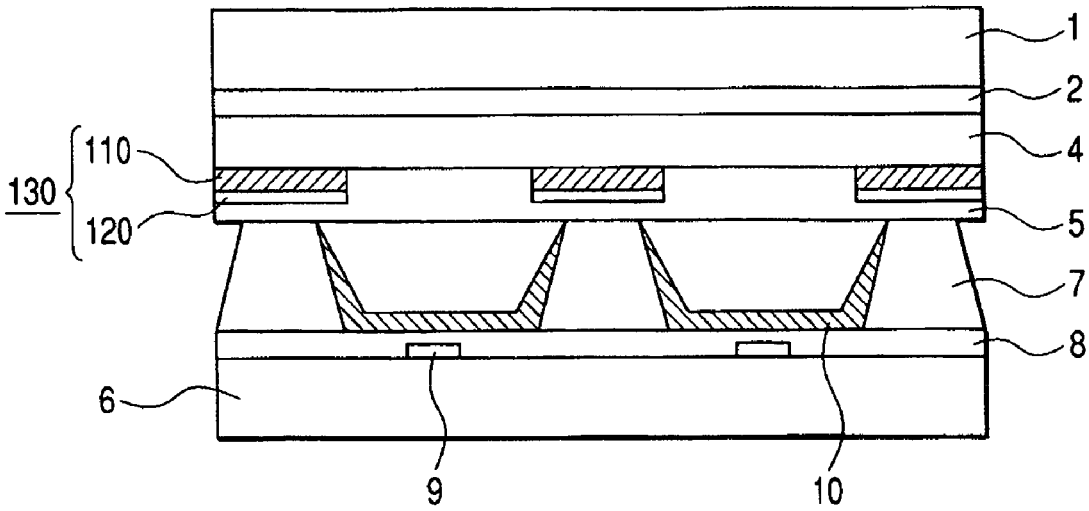
FIG. 12 is a cross-sectional view of the plasma display panel serving as the comparative example of FIG. 11 taken along line X-X' of FIG. 11.

Fabricated for comparison purposes are plasma display panels employing laminated members comprised of the light absorption layer and the light reflection layer which are approximate in plan-view shape to an entire or partial contour of each of the discharge cells, and which are in the form of stripes disposed along the peripheries of each of the discharge cells. FIG. 11 is a front view of the comparative sample of the plasma display panel, and FIG. 12 is a cross-sectional view of the comparative sample of FIG. 11 taken along line X-X' of FIG. 11. The laminated members 130 comprised of the light absorption layer 110 and the light reflection layer 120 were fabricated in the form of stripes on the surface of the same front substrate as that of the plasma display panel already explained in connection with FIG. 2.

Initially, a paste composed of chromium oxide particles, low-melting glass powders, a binder and a solvent is prepared for the light absorption layer 110. The light absorption layer 110 made of chromium oxide was fabricated by coating the paste on the substrate by using a screen printing method, and then volatilizing the solvent drying the paste. Next, a paste composed of titanium oxide particles, low-melting glass powders, a binder and a solvent is prepared for the light reflection layer 120. This paste is coated so as to overlie the light absorption layer 110 by using a screen printing method to form the light reflection layer 120, and then the binder and the solvent are burnt out by drying and firing the paste.

In this way, the laminated members 130 comprised of the light absorption layer 110 and the light reflection layer 120 were fabricated in the form of stripes. The plasma display panels were fabricated by filling a discharge gas between the front and rear substrates and then sealing the front and rear substrates together. The plasma display panels having various aperture ratios were fabricated by varying the width of the laminated members 130 comprised of the light absorption layer 110 and the light reflection layer 120.

Figure 13A:
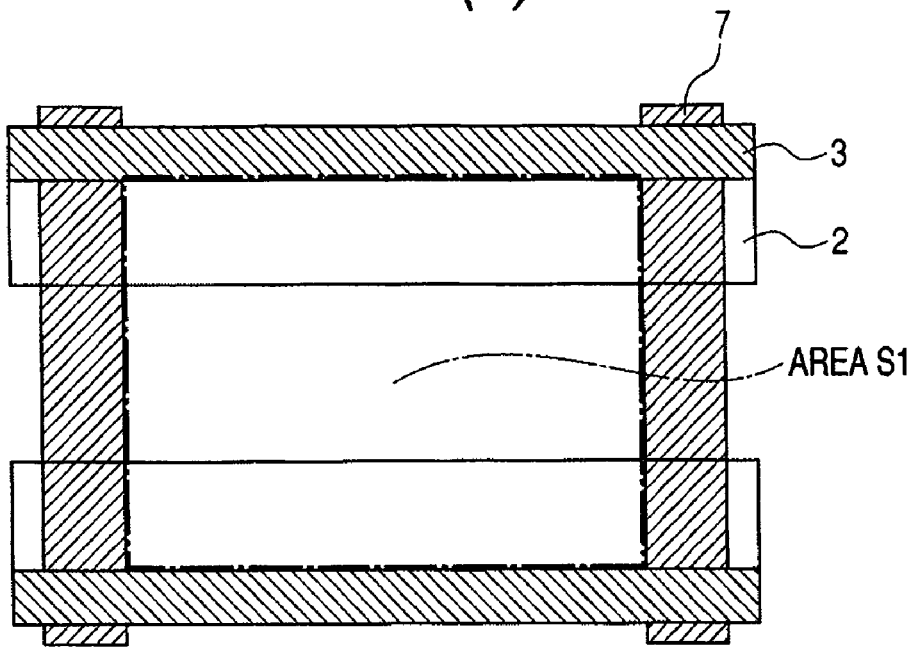
FIG. 13(*a*) is a front view of a plasma display panel for explaining its light-emissive area.
Figure 13B:
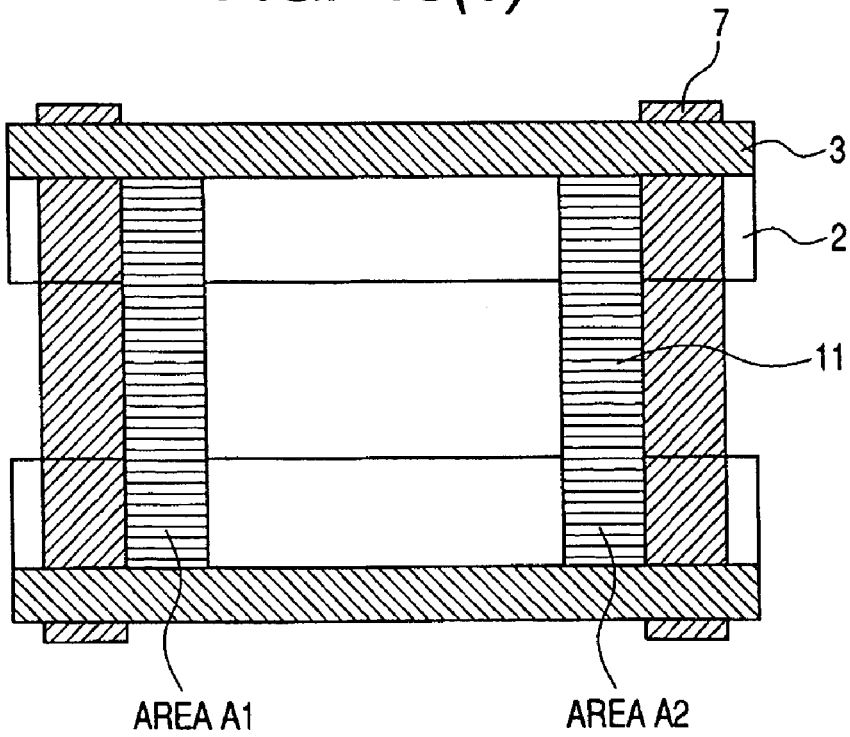

In a unit cell in a front view of the plasma display panel shown in FIG. 13(*a*), S1 is defined as a light-emissive area enclosed by dot-and-dash lines, and S2 is defined as the sum of areas occupied by the light absorption layers within the area S1. The sum S2 of areas of the light absorption layers in FIG. 13(*b*) is the sum of an area A1 and an area A2. The aperture ratio is defined as (S1-S2)/S1 based upon the above definitions.

In the following, examples employing various shapes of the laminated members will be explained, and in these examples the aperture ratio will be defined as described above.

EXAMPLE 1

Figure 14:
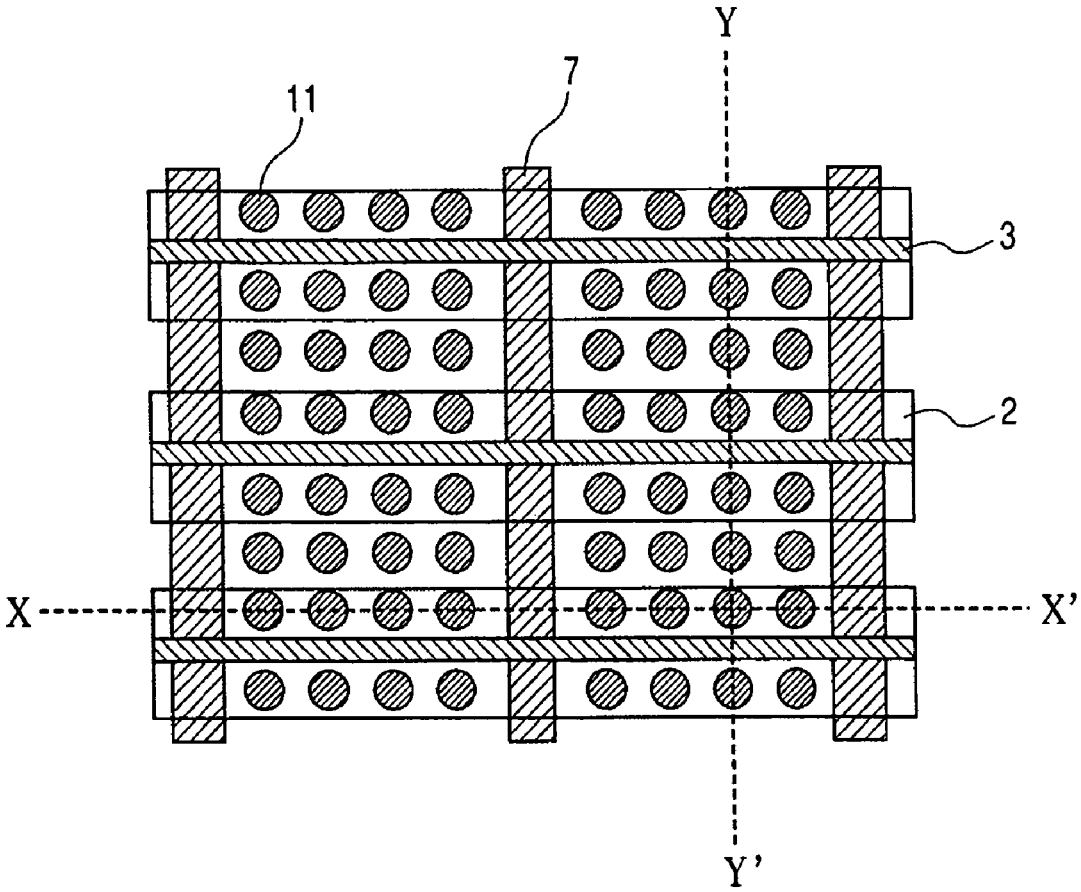
FIG. 14 is a schematic front view of Example 1 of the present invention.
Figure 15:
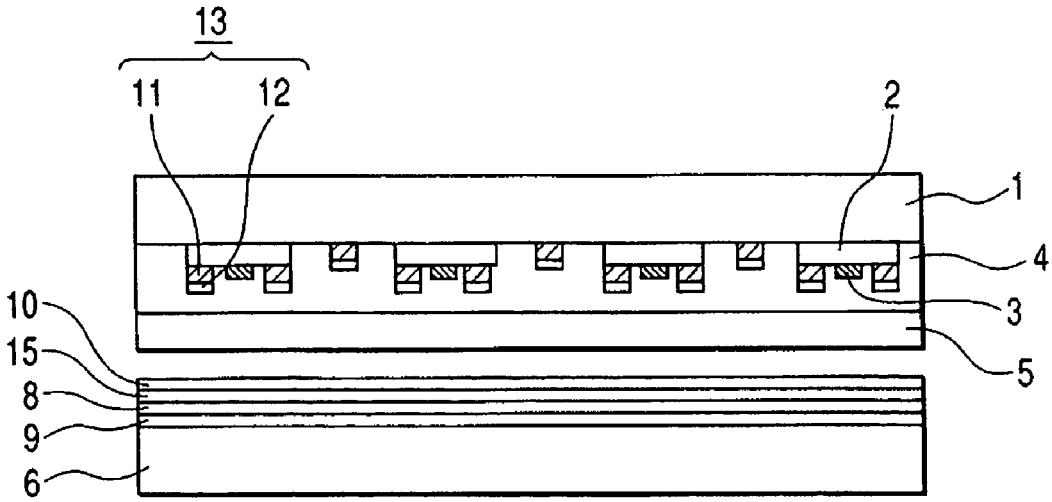
FIG. 15 is a cross-sectional view of Example 1 of FIG. 14 taken along line Y-Y' of FIG. 14.
Figure 16:
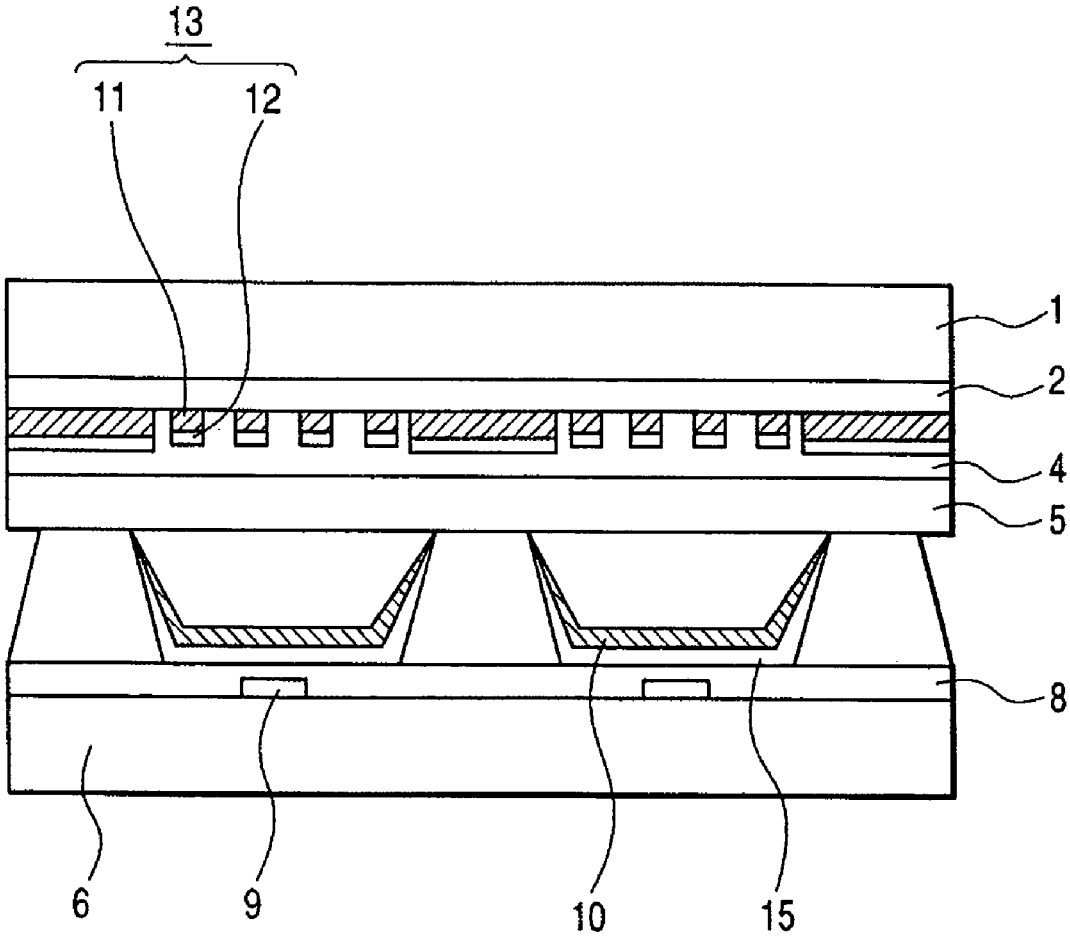
FIG. 16 is a cross-sectional view of Example 1 of FIG. 14 taken along line X-X' of FIG. 14.

FIG. 14 is a front view of a structure of a plasma display panel in accordance with Example 1, FIG. 15 is a cross-sectional view of the structure of FIG. 14 taken along line Y-Y1 of FIG. 14, and FIG. 16 is a cross-sectional view of the structure of FIG. 14 taken along line X-X1 of FIG. 14.

After electrodes 2 and 3 were fabricated on the front substrate, the laminated members 13 comprised of the light absorption layer 11 and the light reflection layer 12 were fabricated. The light absorption layers 11 were made of chromium oxide.

Initially, a paste composed of chromium oxide particles, low-melting glass powders, a binder and a solvent is prepared for the light absorption layers 11. The paste is coated on the substrate by using a screen printing method, and then the solvent was volatilized by drying the paste. Next, the light reflection layers 12 made of titanium oxide were fabricated. Initially, a paste composed of titanium oxide particles, low-melting glass powders, a binder and a solvent is prepared for the light reflection layer 12. This paste is coated so as to overlie the light absorption layer 11 by using a screen printing method to form the light reflection layer 12, and thereafter the binder and the solvent are burnt out by drying and firing the paste. Next, the dielectric 4 and the protective film 5 are fabricated to complete the front substrate. The plasma display panels were fabricated by filling a discharge gas between the front and rear substrates and then sealing the front and rear substrates together. Several plasma display panels having various aperture ratios were fabricated by adjusting the sizes and the number of the laminated members 13 comprised of the light absorption layer 11 and the light reflection layer 12.

Figure 17A:
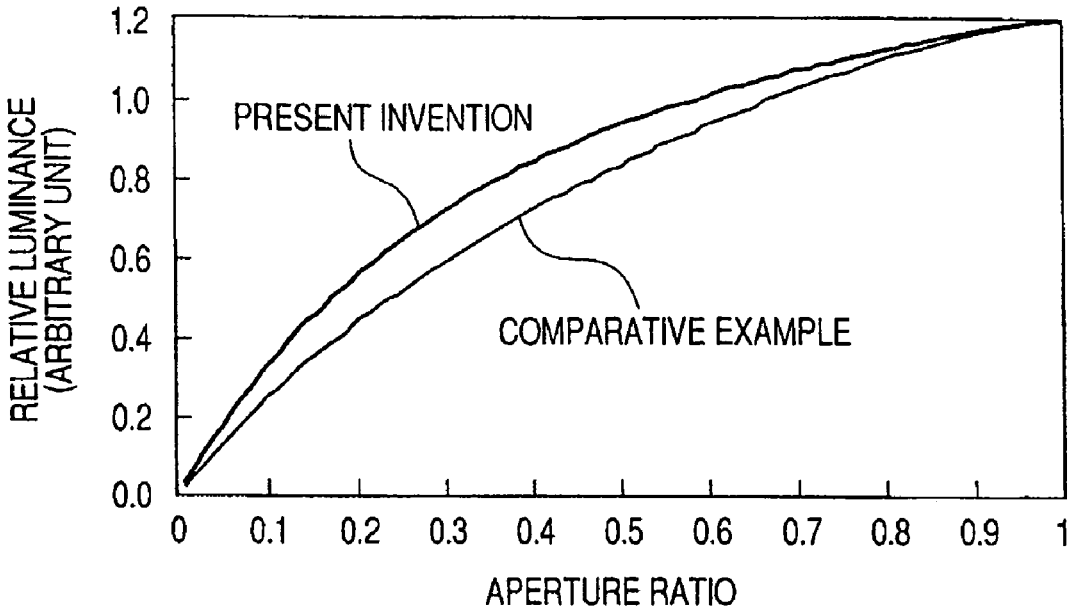
FIG. 17(*a*) is a graph showing relationships between aperture ratios and relative luminance.
Figure 17B:
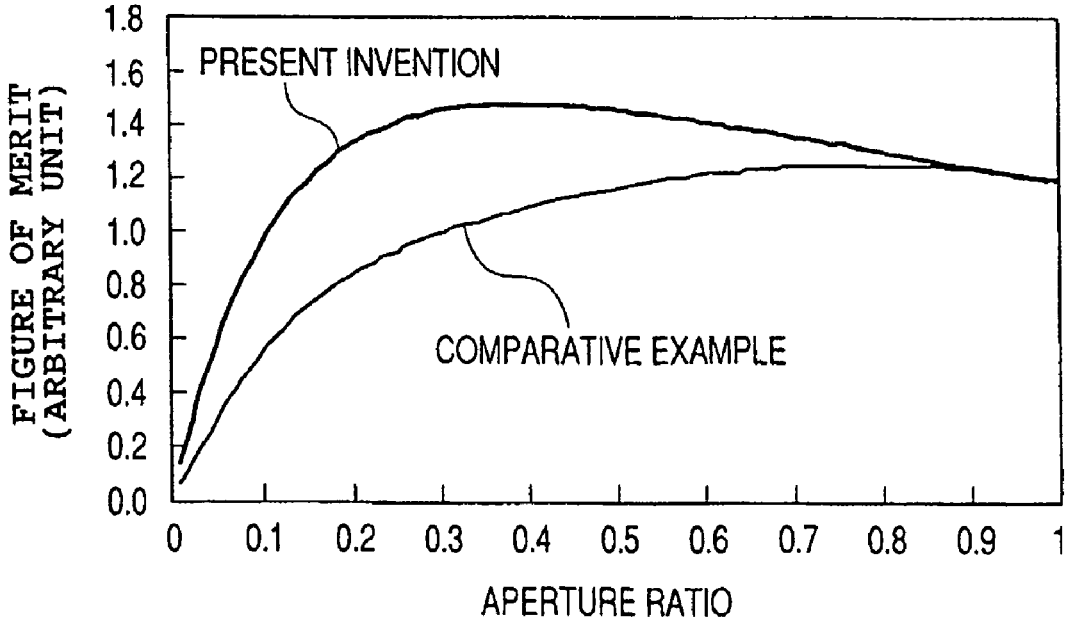

Display luminance of the plasma display panels of this example were measured by connecting a drive circuit to them. The plasma display panels of this example exhibited higher display contrasts compared with those of the plasma display panels which are not provided with the laminated members 13 comprised of the light absorption layer 11 and the light reflection layer 12. FIG. 17(*a*) shows results obtained by measuring display luminance of the plasma display panels of this example. This shows that display luminance was improved compared with the above-described comparative examples by dispersing the laminated members 13 comprised of the light absorption layer 11 and the light reflection layer 12 within each of the discharge cells. The performance of the plasma display panels needs to be evaluated in terms of both display luminance and display contrast. Here, the figure of merit for the plasma display panel is defined as the product of display luminance and display contrast, and FIG. 17(*b*) shows results obtained by measuring the plasma display panels of this example.

The figures of merit of the structure of the plasma display panels of the present invention have exhibited 5% or more improvement over those of the comparative examples when the aperture ratio is in a range of from 0.1 to 0.8.

EXAMPLE 2

Figure 18:
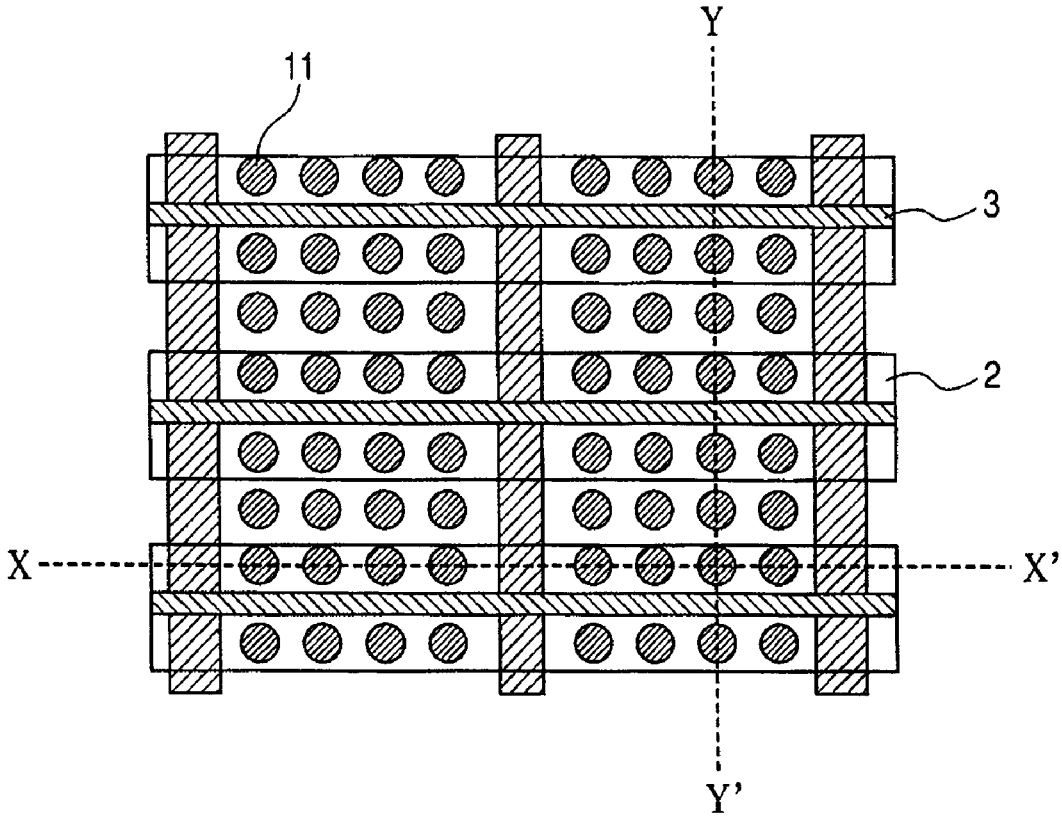
FIG. 18 is a schematic front view of Example 2 of the resent invention.
Figure 19:
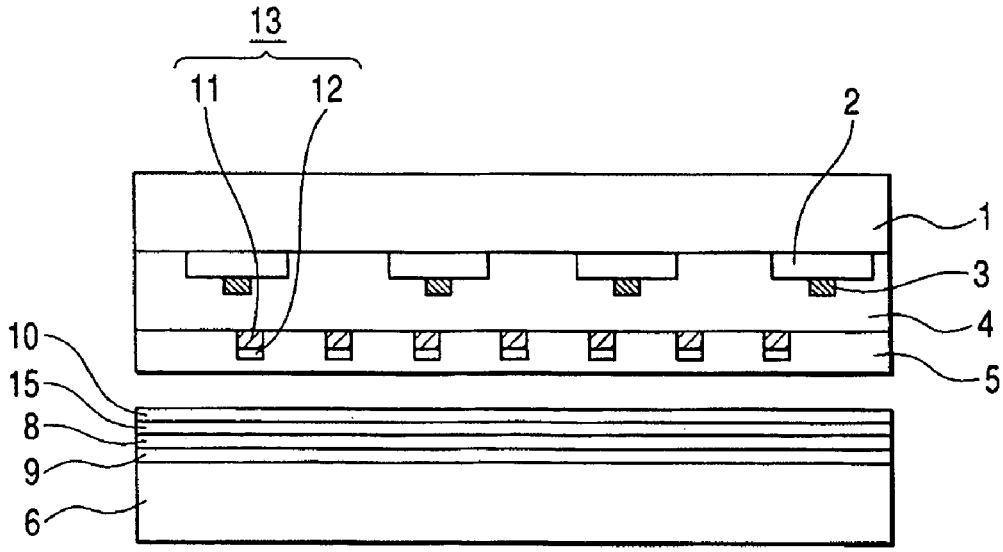
FIG. 19 is a cross-sectional view of Example 2 of FIG. 18 taken along line Y-Y' of FIG. 18.
Figure 20:
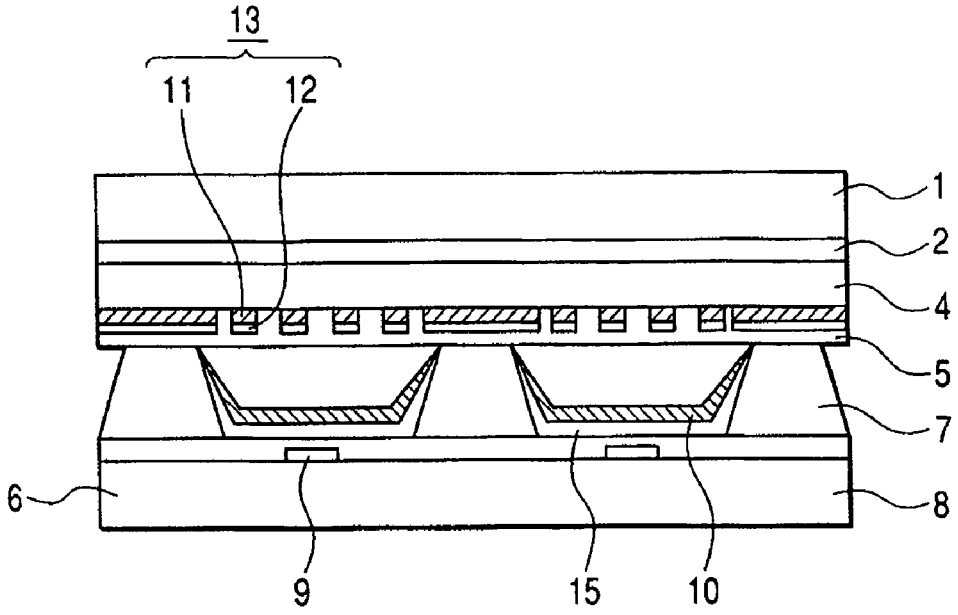
FIG. 20 is a cross-sectional view of Example 2 of FIG. 18 taken along line X-X' of FIG. 18.

FIG. 18 is a front view of a structure of a plasma display panel in accordance with Example 2, FIG. 20 is a cross-sectional view of the structure of FIG. 18 taken along line X-X' of FIG. 18, and FIG. 19 is a cross-sectional view of the structure of FIG. 18 taken along line Y-Y1 of FIG. 18. The plasma display panels of Example 2 were fabricated in the same way as Example 1, except that the laminated members 13 comprised of the light absorption layer 11 and the light reflection layer 12 are disposed on the surface of the layer of the dielectric 4, and their display luminance was measured.

The plasma display panels of Example 2 have exhibited improvement in luminance over the above-described comparative examples with their aperture ratios being in a range of from 0.1 to 0.8, and an improvement in luminance was realized by dispersing the laminated members 13 comprised of the light absorption layer 11 and the light reflection layer 12 within each of the discharge cells.

EXAMPLE 3

This example is similar to Example 1, except that the laminated members 13 comprised of the light absorption layer 11 and the light reflection layer 12 were integrally fabricated to form a unitary structure perforated with plural openings as illustrated in FIG. 8(*b*). The display luminance of the fabricated plasma display panels of Example 3 was measured.

The plasma display panels of Example 3 have exhibited improvement in luminance over the above-described comparative examples with their aperture ratios being in a range of from 0.1 to 0.8, and an improvement in luminance was realized by dispersing the laminated members 13 comprised of the light absorption layer 11 and the light reflection layer 12 within each of the discharge cells.

EXAMPLE 4

This example is similar to Example 1, except that the laminated members 13 comprised of the light absorption layer 11 and the light reflection layer 12 were integrally fabricated to form a unitary mesh-shaped structure perforated with plural square or rectangular openings as illustrated in FIG. 8(*c*). The display luminance of the fabricated plasma display panels of Example 4 was measured.

The plasma display panels of Example 4 have exhibited improvement in luminance over the above-described comparative examples with their aperture ratios being in a range of from 0.1 to 0.8, and an improvement in luminance was realized by dispersing the laminated members 13 comprised of the light absorption layer 11 and the light reflection layer 12 within each of the discharge cells.

EXAMPLE 5

This example is similar to Example 1, except that the laminated members 13 comprised of the light absorption layer 11 and the light reflection layer 12 were formed in a pattern of branches of a tree as illustrated in FIG. 8(*d*). The display luminance of the fabricated plasma display panels of Example 5 was measured.

The plasma display panels of Example 5 have exhibited improvement in luminance over the above-described comparative examples with their aperture ratios being in a range of from 0.1 to 0.8, and an improvement in luminance was realized by dispersing the laminated members 13 comprised of the light absorption layer 11 and the light reflection layer 12 within each of the discharge cells.

EXAMPLE 6

This example is similar to Example 1, except that the laminated members 13 comprised of the light absorption layer 11 and the light reflection layer 12 were integrally fabricated to form a unitary structure perforated with an opening of a pattern of branches of a tree as illustrated in FIG. 8(*e*). The display luminance of the fabricated plasma display panels of Example 6 was measured. The plasma display panels of Example 6 have exhibited improvement in luminance over the above-described comparative examples with their aperture ratios being in a range of from 0.1 to 0.8, and an improvement in luminance was realized by dispersing the laminated members 13 comprised of the light absorption layer 11 and the light reflection layer 12 within each of the discharge cells.

EXAMPLE 7

Figure 21:
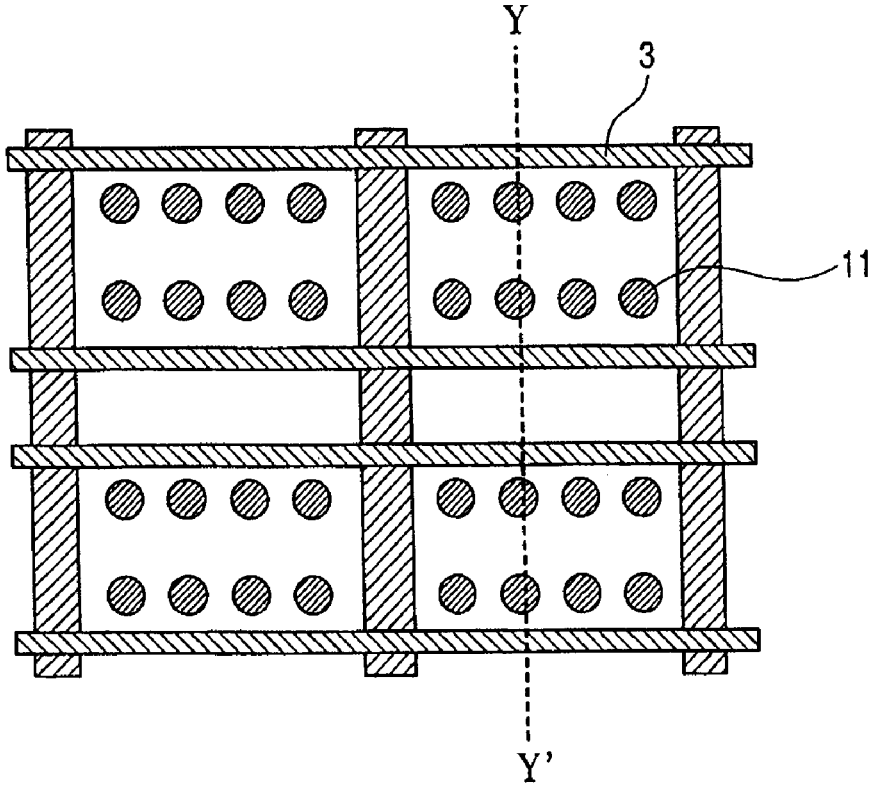
FIG. 21 is a schematic front view of Example 7 of the present invention.
Figure 22:
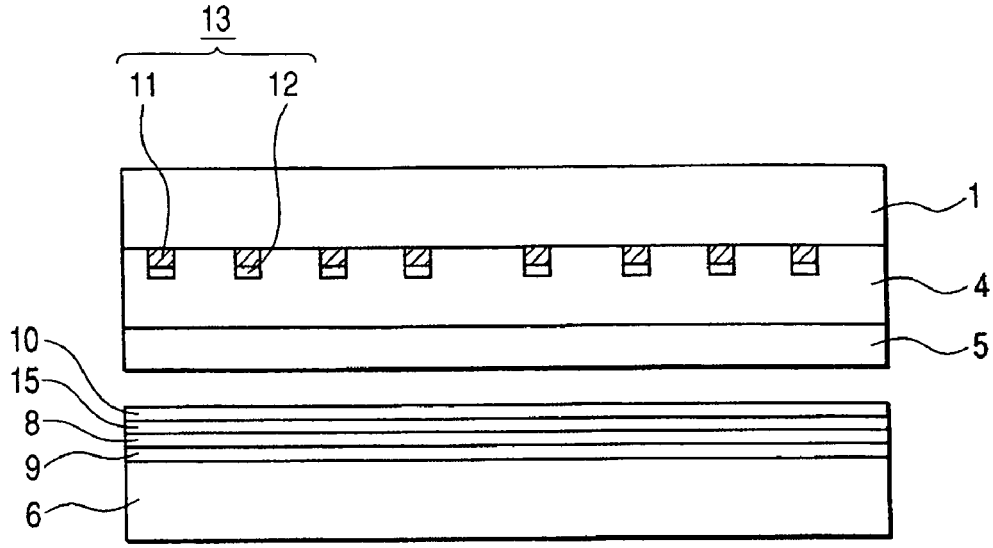
FIG. 22 is a cross-sectional view of Example 7 of FIG. 21 taken along line Y-Y' of FIG. 21.

FIG. 21 is a front view of a structure of a plasma display panel in accordance with Example 7, and FIG. 22 is a cross-sectional view of the structure of FIG. 21 taken along line Y-Y1 of FIG. 21. The structure of Example 7 differs from that of the comparative examples, in that the electrodes disposed on the front substrate are comprised of the laminated members 13 comprising the light absorption layers 11 made of chromium and the light reflection layers 12 made of aluminum, and in that discharge is generated between the plural laminated members 13 and no transparent electrodes are present.

The plasma display panels of the above structure have exhibited improvement in luminance over the above-described comparative examples with their aperture ratios being in a range of from 0.1 to 0.8, and an improvement in luminance was realized by dispersing the laminated members 13 comprised of the light absorption layer 11 and the light reflection layer 12 within each of the discharge cells.

In the following, the laminated member BM in accordance with the present invention will be explained. The laminated member BM of the present invention formed on the front substrate comprises an electrical insulator, an electrical conductor, or a combination of both. The laminate members BM of the present invention are sometimes disposed electrically insulated from the electrode pairs each of which is formed of two electrodes each formed of lamination of a transparent electrode 2 and a bus electrode 3, and in some cases the laminate members BM of the present invention may not be insulated from the electrode pairs. Further, in some cases, portions of the laminate members BM may form portions or the entirety of the electrode pairs.

In the above-described embodiment, the high-luminance high-contrast plasma display panel is realized by considering only the conception of the laminated members 13 being dispersed in a given plane within each of the discharge cells, and in the following embodiment, the high-luminance high-contrast plasma display panel is realized by considering the discharge cells in three dimensions.

In the following, the length dbm of the size of the laminated member BM will be defined. Consider one of the discharge cells as in the case of the previous embodiment. A BM region is defined as a region occupied by the laminated member BM in the above-explained display surface. Visible light generated in the discharge space cannot enter the viewing space through the BM region because of the property of the BM region. A light-transmissive region is defined as a region in the display surface through which the visible light from the discharge space can enter the viewing space. A non-BM region is defined as a region in the display surface other than the BM region. Usually the light-transmissive region is the non-BM region. However, if there is a component which prevents the visible light from entering the viewing space from the discharge space, for example, bus electrodes 3, other than the laminated member BM, then the light-transmissive region is part of the non-BM region. Returning to FIG. 7, consider an arbitrary point A in the BM region. Dbm-A is defined as the shortest distance between the point A and the light-transmissive region. The length Lave of the size of the laminated member BM is defined as the value of the dbm-A averaged over the entire BM region. Since it is preferable to increase the number of the laminated members disposed within each of the discharge cells by making the laminated members as small as possible, it is desirable to select the ratio of Lave to L to be 1/2 or smaller, where L is a typical size of the cell (See FIG. 7).

That is to say, it is desirable that $Lave/L \leqq 1/2$. Further, in a case where the phosphor film 10 and its underlying reflection layer 15 reflect the visible light diffusely, for the purpose of reducing the number of multiple reflections it is desirable that $Lave<hd$ (i.e. $0<Lave/hd<1$), where hd is a BM height which is the average of distances between the surface of the phosphor film and the phosphor-film-side surface of the laminated member BM, as measured perpendicularly to the display surface.

Further, in a case where the phosphor film is fabricated on the rear substrate in a plane approximately parallel with the display surface (the plane will be called the bottom surface of the phosphor film), the BM height hd is a distance between the bottom surface of the phosphor film and the phosphor-film-side surface of the laminated member BM, that is to say, hd is a distance between the phosphor film and the laminated member BM. More generically, the BM height hd is the average of distances between a bottom surface of a discharge space and a discharge-space-side surface of laminated members BM, as measured perpendicularly to a display surface, where a plane containing the laminated members BM is considered, and the bottom surface of the discharge space is defined as a plane which faces the above-mentioned plane across the discharge space and bounds the discharge space.

The reason why the above configuration produces the beneficial effects of the present invention is that a larger amount of the visible light is projected into the viewing space without undergoing further multiple reflections after the visible light is reflected by the light reflection layers of the laminated members BM and then is diffusely reflected by the phosphor film. The following is the reason: The visible light spreads approximately as wide as the distance hd until the visible light reaches the plane containing the laminated members BM (the plane approximately parallel with the display surface) after the visible light is reflected diffusely by the surface of the phosphor film and thereafter propagates in the discharge space. A portion of the spread visible light (a finite amount of the visible light, and in some cases a large amount of the visible light) is emitted into the viewing space through the light-transmissive regions.

In a case where the laminated members BM are employed in the usual structure, the BM height hd is approximately equal to the height hds of the discharge space.

In the case of the PDP employing the structure explained in the "BACKGROUND OF THE INVENTION" section, the height hds of the discharge space is the distance between the surface of the phosphor film and the surface of the front substrate. FIG. 7 depicts the height hds of the discharge space. Usually the height hds of the discharge space is in a range of from 0.1 mm to 0.2 mm. However, the values of the height hds of the discharge space vary with the structures of PDPs to which the present is applied. In the case of PDPs of the vertical-discharge type, or PDPs having an ultra-large viewing screen, for example, the height hds of the discharge space are selected to be larger.

The above condition $0<Lave/hd<1$ is a condition required for obtaining general advantages of the present invention. The condition for heightening the beneficial effects of the present invention based on the above-explained principle of the present invention is $0<Lave/hd<0.5$, and is preferably $0<Lave/hd<0.2$. However, Lave becomes smaller as Lave/hd ($>0$) is decreased for heightening the beneficial effects further, and consequently, there arises a need for fabricating the laminated members BM of finer structures. That is to say, there arise problems of difficulties in manufacture and an increase in manufacturing cost.

On the other hand, in a case where some limited advantages of the present invention are desired without pursuing the highest performance, some advantages of the present invention can be obtained by the condition 0<Lave/hd<2, the condition 0<Lave/hd<3, or the condition 0<Lave/hd<5, depending upon the desired performance. With these configurations, the value of Lave is made greater, and therefore there is provided an advantage of facilitating the manufacture of the laminated members BM.

Further, the value of Lave capable of being fabricated is usually 0.01 mm or more, and in view of the ease of the manufacture, it is preferable to select the value of Lave to be 0.02 mm or more, 0.05 m or more, or 0.10 mm or more, depending upon the desired performance. However, the value of Lave may be selected to be 0.01 mm or less, if fabrication techniques are available. In principle, the minimum value of Lave is of the order of wavelengths of visible light, and therefore it is preferable in principle to select the value of Lave to be 0.0005 mm (0.5 nm).

To make the advantages of the present invention pronounced, the higher the reflectance of the phosphor film, the better the performance. The advantages of the present invention are obtained when the reflectance of the phosphor film is 0.5 or more. The advantages of the present invention can be made more pronounced by selecting the reflectance of the phosphor film to be 0.7 or more, 0.9 or more, or 0.95 or more depending upon the desired performance.

EXAMPLE 8

Figure 23:
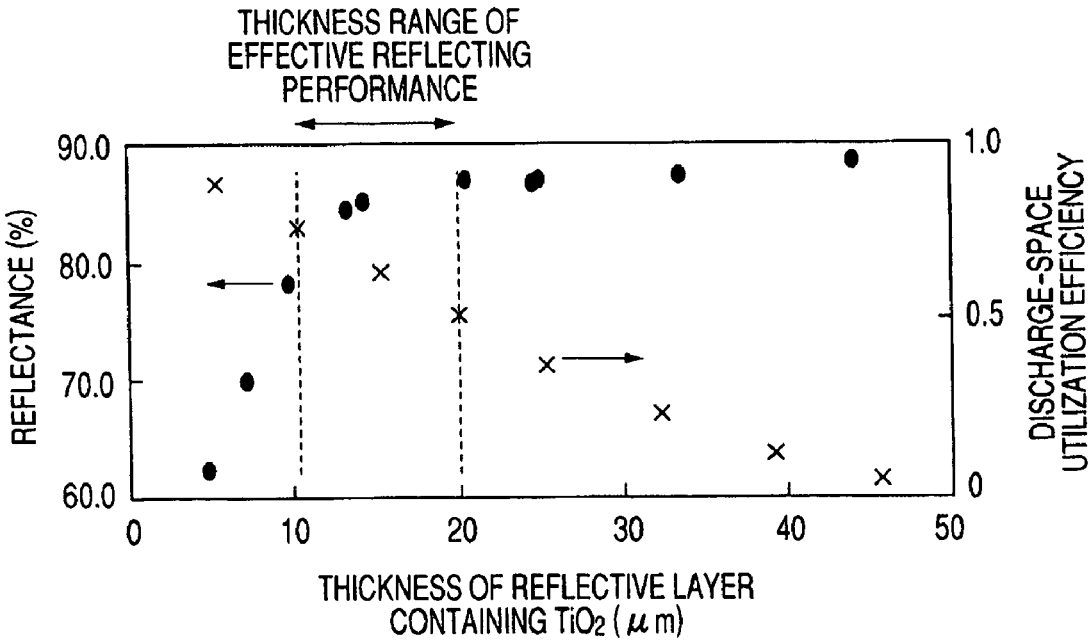
FIG. 23 is a graph showing a relationship between the reflectance and thickness of the reflection layers and a relationship between the discharge-space utilization efficiency and the thickness of the reflection layers.

In Example 1, the reflection layer 15 was fabricated by mixing titanium oxide ($TiO_2$) powders with glass material. Here the reflection layers 15 of various thicknesses were fabricated with the glass proportion in the reflection layers 15 being 50% by volume, and the reflectance of the reflection layers 15 were measured, and the measured results are shown in FIG. 23. The display luminance of plasma display panels employing those reflection layers 15 was measured. In the plasma display panels utilizing the reflection layers 15 having the $TiO_2$ film of 10 μm or more in thickness, that is, the reflection layers exhibiting the reflectance of about 80% or more, display luminance was made higher than that of the above-described comparative examples, and increasing of the thickness of the reflection layers 15 realized improvement in display luminance.

FIG. 23 also shows the results of discharge-space utilization efficiency computed for various thicknesses of the reflection layer 15 in a discharge cell of 250 μm in cell diameter, assuming the thickness of the phosphor film to be 15 μm. Here the discharge-space utilization efficiency Ed is defined as Ed=A×V, where V=a volume of a discharge space, and A is a constant determined by the shape and material of a discharge cell.

Plotted with x marks (with the scale on the right-hand side of the plot) in FIG. 23 are the results of the discharge-space utilization efficiency Ed computed for a discharge space of 250 μm in equivalent diameter and 400 μm in height with the thickness of the reflection layer being varied from 0 μm to 50 μm, and with the thickness of the phosphor films being fixed at 15 μm. The discharge-space utilization efficiency Ed in FIG. 23 is normalized to the reflection layer of 0 μm in thickness. The experimental results showed that it is preferable to select the discharge-space utilization efficiency Ed to be 0.5 or more for stable operation of discharges in the plasma display panels, and this means that the stable operation of discharges is obtainable for the thickness of the reflection layer equal to or smaller than 20 μm. Therefore it is preferable to the thickness of the reflection layer to be in a range of 10 μm to 20 μm.

EXAMPLE 9

Figure 24:
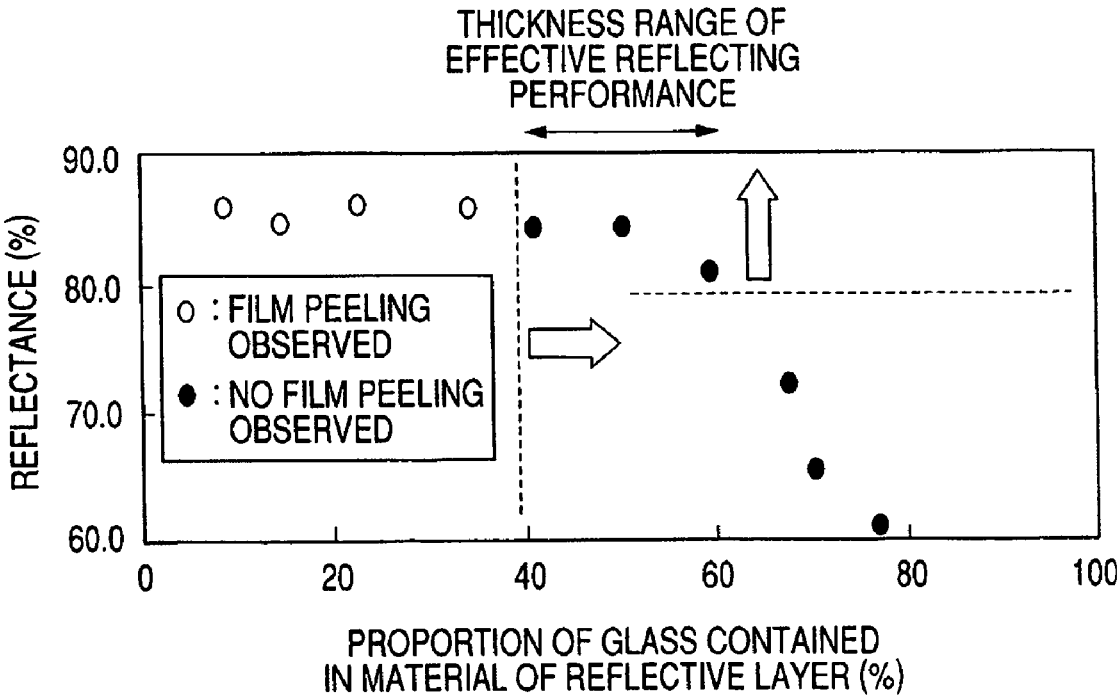
FIG. 24 is a graph showing a relationship between the reflectance and the glass proportions of the reflection layers.

In Example 8, the reflection layers 15 of various glass proportions contained in the reflection layers 15 were fabricated, their reflectance were measured, and the measurement results are shown in FIG. 24. Display luminance of plasma display panels into which the above-fabricated reflection layers 15 were incorporated was measured. Plasma display panels employing the reflection layers 15 the glass proportions of which is smaller than 60% exhibited improvement in luminance over the above-described comparative examples, and improvement in display luminance was realized by adjusting the thickness of the reflection layer 15. However, in the case of the reflection layers 15 having the glass proportions smaller than 40%, a portion of the reflection layers 15 peeled off, resulting in some deterioration in display luminance. Consequently, plasma display panels having also sufficient physical strength were fabricated by selecting the glass proportion of the reflection layer 15 to be in a range of from 40% to 60%.

While the reflection layers were fabricated by mixing the glass material with the reflection material in this Example, members supporting the phosphor films, for example, ribs themselves, can be configured to substitute the reflection layer 15 to visible light. The ribs are comprised of glass, and here, the substitutes for the reflection layers were realized by fabricating the white ribs mixing the glass with white oxide powders, as in the case of the reflection layer 15. The ribs performing the same function were fabricated by using white ceramic materials.

EXAMPLE 10

Figure 25A:
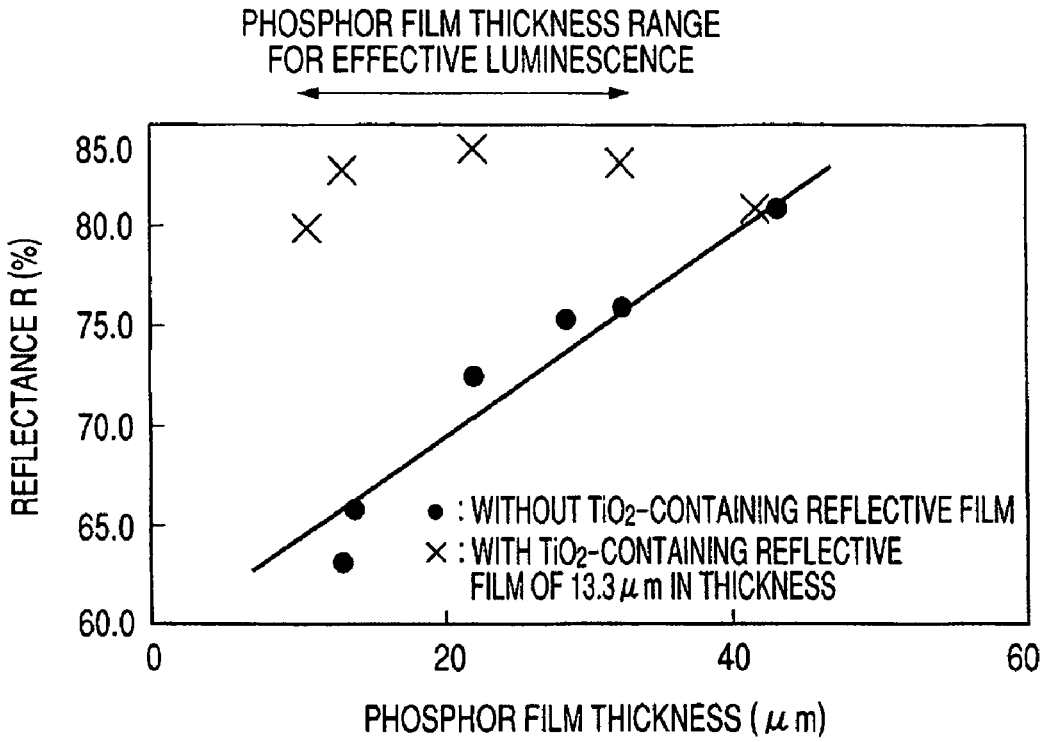
FIG. 25(*a*) is a graph showing a relationship between the reflectance and the thickness of the phosphor films.
Figure 25B:
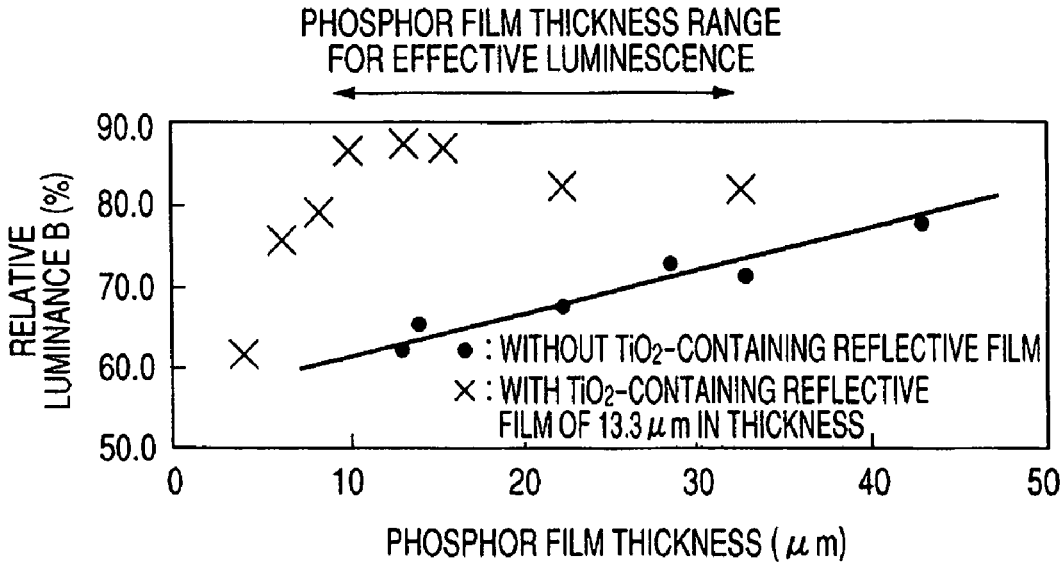

In Example 8, the $TiO_2$-containing, 13.3-μm-thick reflection layer 15 was fabricated by selecting the glass proportion of the reflection layers 15 to be 50% by volume. Reflectance of the reflection layer 15 was measured by varying the thickness of the phosphor film superposed on the reflection layer 15, and the measured reflectance are shown in FIG. 25(*a*). Plasma display panels were fabricated by using the reflection layers having the phosphor films of various thicknesses thereon, their display luminance were measured, and the measured results are shown in FIG. 25(*b*). Plasma display panels employing the phosphor films 10 of thickness in a range of from 8 μm to 35 μm exhibited improvement in luminance over the above-described comparative examples, and improvement in display luminance was realized by adjusting the thickness of the reflection layer 15.

This Example uses red, green and blue phosphors of about 1 μm to about 4 μm in particle diameter. The phosphor film of 8 μm in thickness is approximately equivalent to three layers of the phosphor particles, and it is known that if the thickness of the phosphor film is greater than its thickness which passes visible light without influencing it, display luminance is increased. It is thought that the greater the thickness of the phosphor film, the higher its luminance. However, it is known that when the thickness of the phosphor film is equal to or greater than 35 μm, the beneficial effect of the reflection layer cannot be used effectively, and that display luminance and discharge-space utilization efficiency are degraded. Therefore the phosphor films having their thicknesses in a range of from 8 μm to 35 μm were used for fabrication of plasma display panels.

Three kinds of phosphors are utilized which correspond to three primary colors, respectively, and reflection of visible light by respective ones of the reflection layers and the phosphor films performs intended functions if the respective ones of the reflection layer and the phosphor film reflect only the light of a color of corresponding ones of the phosphor films. Therefore, a pigment of approximately the same color as the emission color of a corresponding phosphor film was added to the corresponding reflection layer and the corresponding phosphor film. For example, in the case of a red pixel, employed was a configuration in which only the necessary visible light, here a red light, is reflected, but the visible lights of the other colors are not reflected, and thereby the luminous efficacy was further improved.

The used red pigments included inorganic red pigment "iron oxide red," iron oxide ($Fe_2O_3$), cadmium sulfoselenide, and anthraquinone system inorganic pigments. The used green pigments included $TiO_2$—CoO—$Al_2O_3$—$Li_2O$ system, CoO—$Al_2O_3$—$Cr_2O_3$—$TiO_2$ system, CoO—NiO—ZnO—TiO system oxide inorganic pigments, green chlorinated phthalocyanine system, green brominated phthalocyanine system pigments. The used blue pigments included cobalt blue system, blue phthalocyanine system pigments, blue cobalt aluminate pigments, blue CoO—$Al_2O_3$ system oxide pigments, and blue ultramarine pigments.

While in Examples 8-10, the improvement on display luminance was realized by the plasma display panels employing the light absorption layer and the light reflection layer in accordance with Example 1, plasma display panels not employing the light absorption layer and the light reflection layer of Example 1 also provided improvement in display luminance.

EXAMPLE 11

Figure 26A:
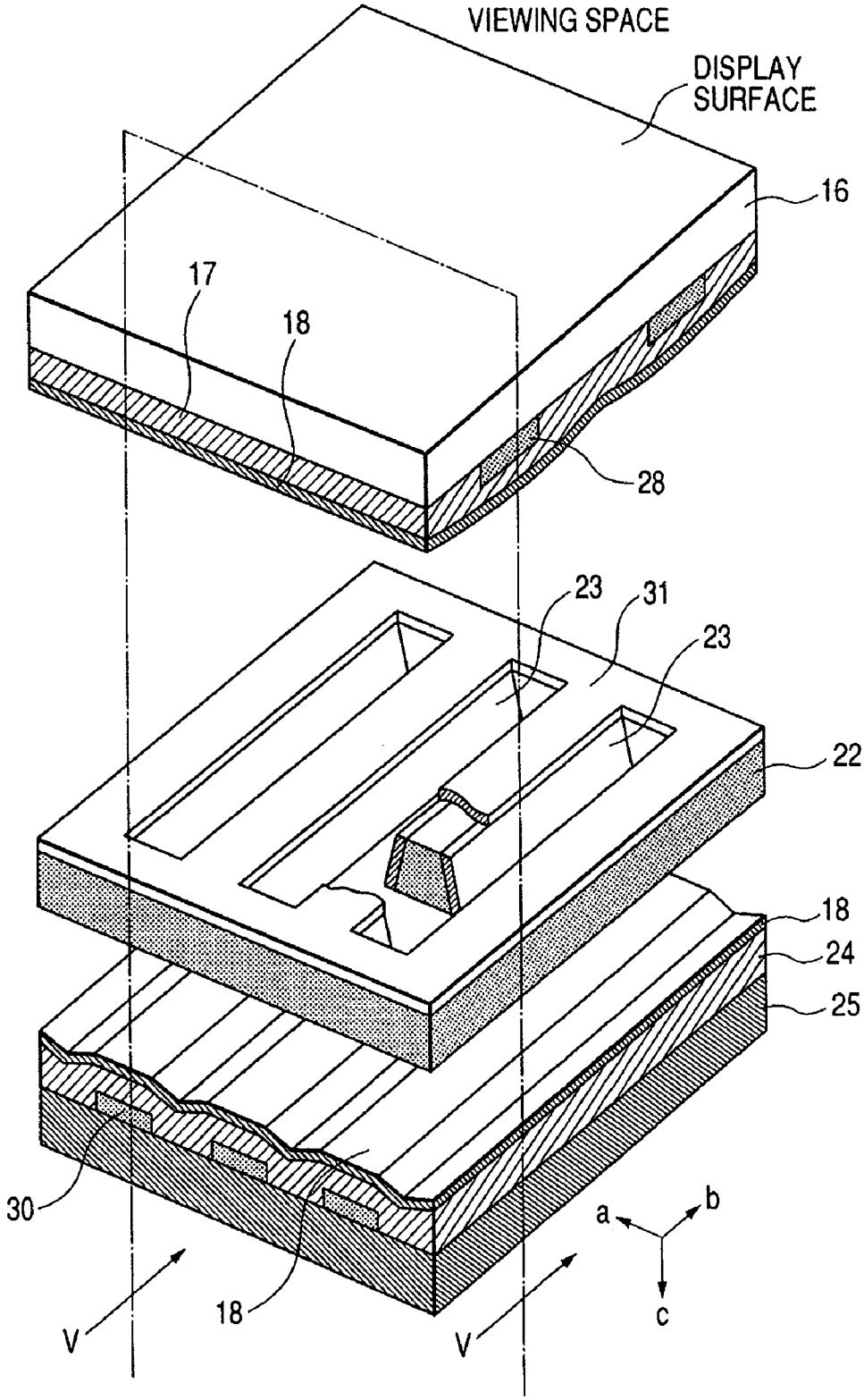
FIG. 26(*a*) is an exploded perspective view of part of a PDP in accordance with an example of the present invention.
Figure 26B:
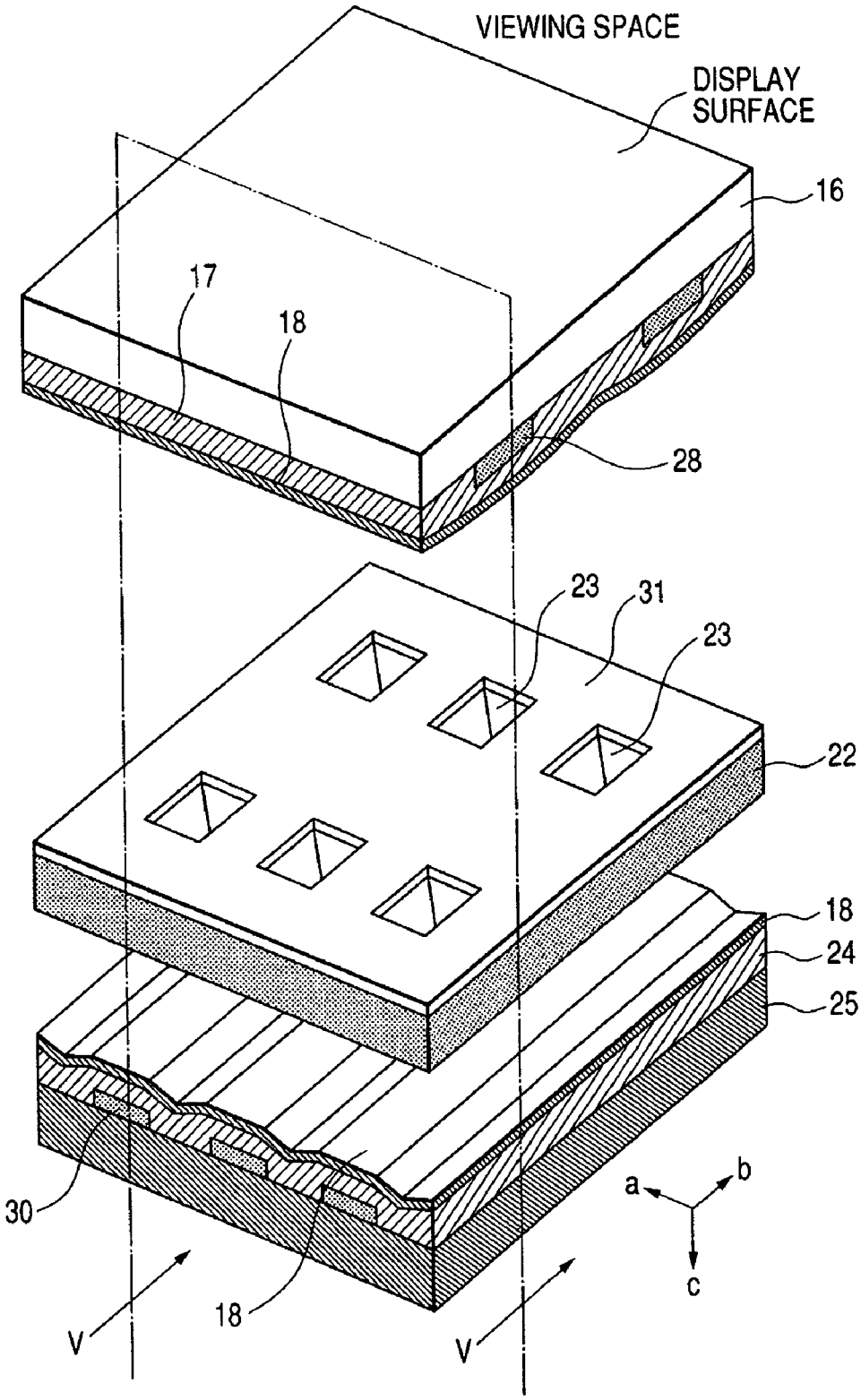

FIG. 26(*a*) is an exploded perspective view of an example of the plasma display panel in accordance with the present invention. Scan electrodes 28 are fabricated so as to extend in a direction of an arrow a on a front substrate 16, a dielectric 17 is disposed to cover the scan electrodes 28, and then a protective layer 18 is disposed to cover the dielectric 17.

Figure 27:
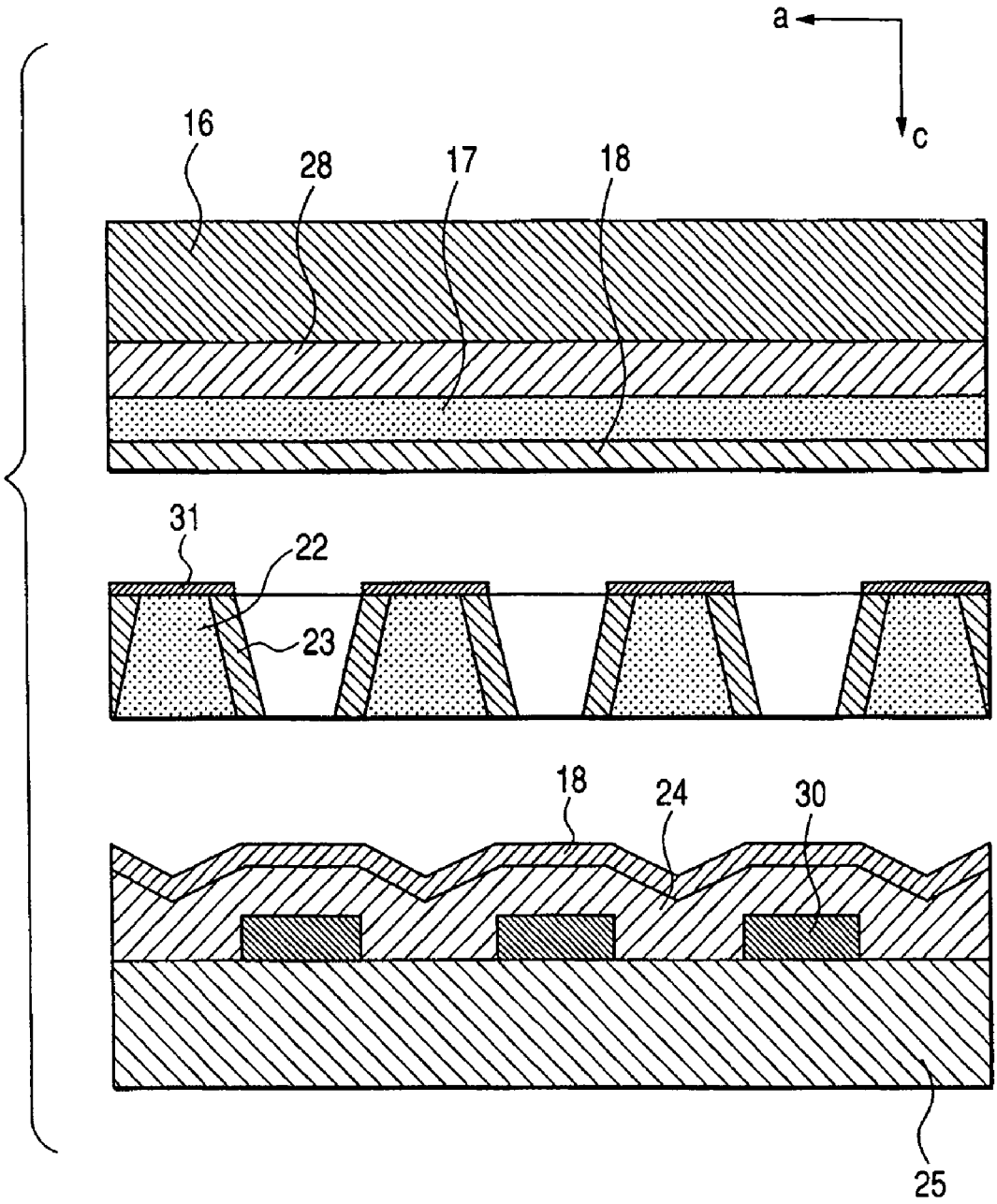
FIG. 27 is a cross-sectional view of the PDPs of FIGS. 26(*a*) and 26(*b*) taken along line V-V of FIGS. 26(*a*) and 26(*b*)

An integral structure comprised of the front substrate 16, the scan electrodes 28, the dielectric 17 and the protective layer 18 is hereinafter referred to as a front plate. A barrier rib plate 22 is provided with apertures in the form of stripes or grids. Phosphors 23 are coated on the wall surfaces of the apertures, and a black matrix 31 is formed on the top surface of the barrier rib plate 22. FIG. 26(*a*) is an exploded perspective view of an example of the PDP employing the barrier rib plate 22 provided with the apertures in the form of stripes, and FIG. 26(*b*) is an exploded perspective view of an example of the PDP employing the barrier rib plate 22 in the form of a grid. The black matrix 31 is comprised of black opaque material, defines a window portion (an aperture) of the front substrate 16 through which the visible light is irradiated from each of the discharge cells into the outside of the front substrate 16, and fills spaces between the window portions (the aperture portions) with the black opaque material. The barrier rib plate 22 is a glass plate comprised of much the same material as that of the front and rear substrates 16, 25, and is fabricated as by using a sandblasting method, a screen printing method, a method by using a photosensitive material for barrier ribs, or a machining method. The black matrix 31 can be fabricated by mixing a metal such as chromium, or carbon as pigments into glass material. The rear substrate 25 is fabricated as follows. Data electrodes 30 are fabricated so as to extend in a direction of an arrow b on a rear substrate 25, a dielectric 24 is disposed to cover the data electrodes 30, and then a protective layer 18 is disposed to cover the dielectric 24. FIG. 27 is a cross-sectional view of the PDP illustrated in FIGS. 26(*a*) and 26(*b*) viewed in the direction of an arrow b of FIGS. 26(*a*) and 26(*b*), and taken along line V-V therein before the PDP is assembled. While the wall surfaces of the plural apertures in the barrier rib plates 22 are perpendicular to the front substrate 16 in FIG. 26, in this example the wall surfaces of the plural apertures in the barrier rib plates 22 are tilted from the normal to the front substrate 16 as shown in FIG. 27, and consequently, the visible light generated on the surface of a two-layer structure 23 composed of a phosphor film and a reflection layer can be irradiated efficiently into the viewing space.

Assembling of the plasma panel is carried out as follows. Initially, an adhesive agent (not shown) such as glass frit is disposed at a peripheral portion of one of the front substrate 16 and the rear substrate 25, and then the three layers comprised of the front substrate 16, the barrier rib plate 22 and the rear substrate 25 are stacked and hermetically sealed such that mutually opposing scan electrodes 28 and data electrodes 30 are perpendicular to each other. Next, after removing impurities remaining at a p-tube (for exhausting and filling of gases) provided at a periphery of the plasma panel, the plasma panel is evacuated to vacuum, thereafter are filled with rare gases for discharges, and then the p-tube is sealed off.

In this example the gas contains a xenon (Xe) gas. Let ng be a volume particle (atom or molecule) density of the discharge gas, and let nXe be a volume particle density of the Xe gas, and let a Xe proportion, aXe, in the discharge gas be nXe/ng. In this example, the Xe proportion, aXe, in the discharge gas is selected to be 0.12 or more. It is very important for increasing a luminous efficacy of the plasma display devices to increase an ultraviolet ray production efficiency by discharge. Methods for increasing the ultraviolet ray production efficiency of the plasma display device are basically divided into following two kinds of techniques: (1) increasing of the Xe proportion aXe of the discharge gas; and (2) increasing of the product pd in discharge, where the product pd is a product of the pressure p of the discharge gas and a distance d between the discharge electrodes.

Figure 28A:
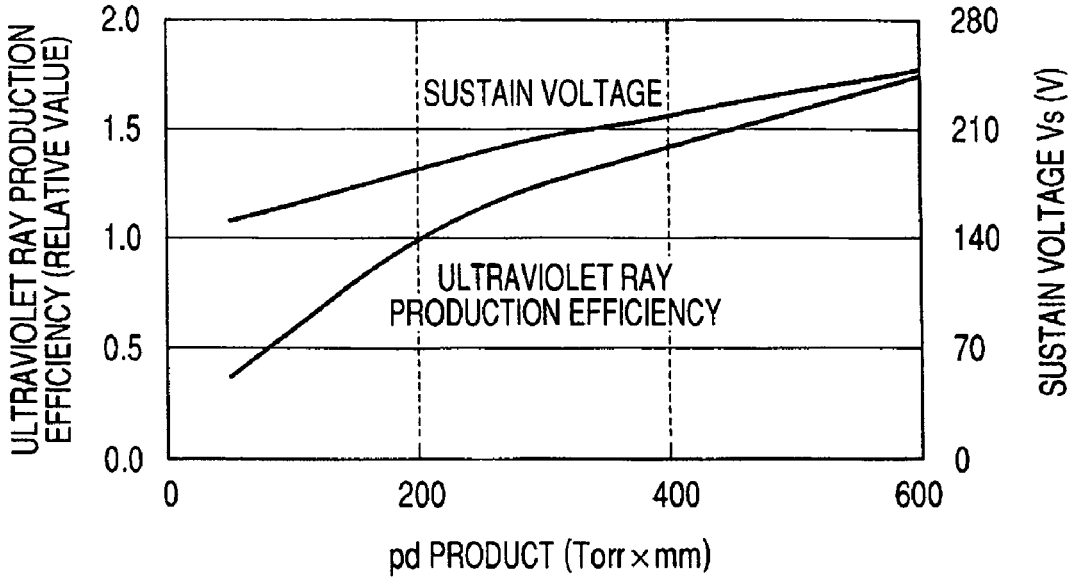
FIG. 28(*a*) is a graph showing a relationship of the ultraviolet ray production efficiency and the sustain voltage Vs versus the product pd.
Figure 28B:
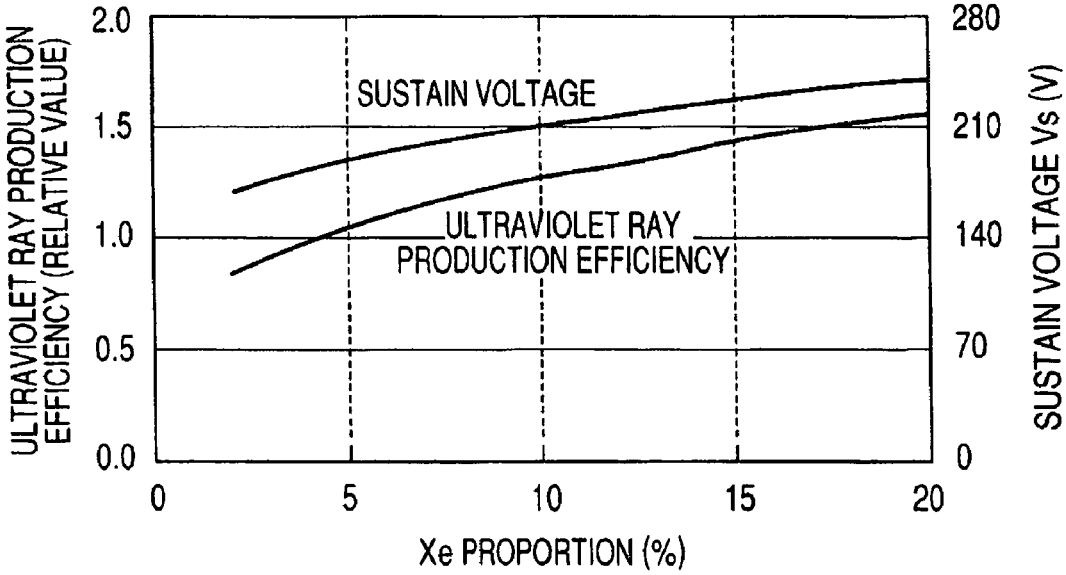
Figure 28C:
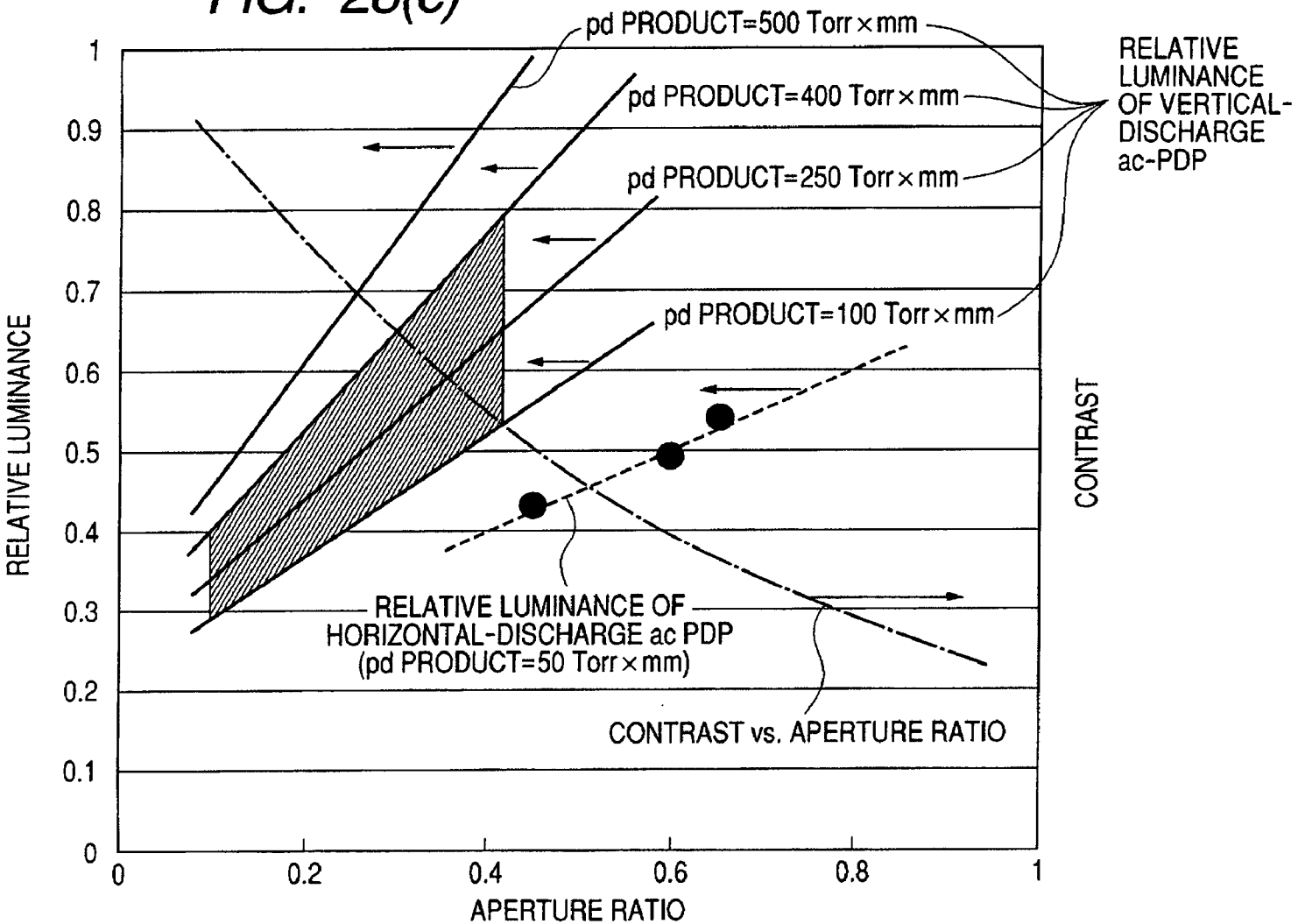

FIGS. 28(*a*) and 28(*b*) show the above effects in terms of relative values of the ultraviolet ray production efficiencies. FIG. 28(*a*) shows the ultraviolet ray production efficiencies and sustain (display discharge) voltages Vs when the product pd is varied at the Xe proportion aXe=4%, and FIG. 28(*b*) shows the ultraviolet ray production efficiencies and sustain (display discharge) voltages Vs when the Xe proportion aXe is varied for the product pd=200 Torr×mm. Here, the sustain (display discharge) voltage Vs is an effective voltage to be applied between the display electrodes for sustaining a display discharge.

In the conventional PDPs, the Xe proportion aXe is usually selected to be in a range of from 4% to 10%. In this example, the ultraviolet ray production efficiency is improved by increasing the Xe proportion aXe further to 12% or more. Since increasing of the Xe proportion aXe is accompanied by an increase in the sustain (display discharge) voltage Vs, it is preferable to select the Xe proportion aXe to be 30% or less.

The pressure p of the discharge gas is usually 500 Torr. In the case of the conventional ac surface-discharge type PDPs, the distance between the discharge electrodes is approximately 0.1 mm, the product pd in FIG. 28(*a*) is 50 Torr×mm. FIG. 28(*a*) shows that increasing of the distance d between the discharge electrodes increases the luminous efficacy when the gas pressure is kept constant. However, in the conventional PDPs, since the distance d between the discharge electrodes can be increased only by increasing the distance in parallel with the surface of the substrate, it is impossible to increase the distance d without increasing the pitch between cells. On the other hand, in the case of the ac vertical-discharge type PDPs, since the distance d between the discharge electrodes can be increased in a direction perpendicular to the substrate of the plasma panel, the distance d between the discharge electrodes can be increased to 0.2 mm or more without changing the pitch between cells forming the pixels, and consequently, the luminous efficacy of the PDPs can be improved.

Here, let S1 be an area of a projection of a space occupied by one of the plural discharge cells onto the front substrate 16, let S2 be an area of a window portion of the front substrate 16 through which the visible light is irradiated from the one of the discharge cells into the outside of the front substrate 16, and S2/S1 shall be called an aperture ratio.

Shown by broken lines in FIG. 28(*c*) are a relationship between relative luminance and aperture ratios and a relationship between display contrast ratios and aperture ratios in the case of a conventional ac surface-discharge type PDPs. Shown by solid lines in FIG. 28(*c*) are relationships between relative luminance and aperture ratios with the product pd as a parameter obtained from plural PDPs of the ac vertical-discharge type. A relationship between display contrast ratios and aperture ratios in the case of the ac vertical-discharge type PDPs is similar to that in the case of the conventional ac surface-discharge type PDPs, and the plotting of the contrast relationship for the ac vertical-discharge type PDPs is omitted, and is substituted by that for the ac surface-discharge type PDPs.

Conventionally, the aperture ratio S2/S1 was usually 0.45 or more, and the aperture ratio S2/S1 for the above-explained ALIS (Alternate Lighting of Surfaces) type PDPs (see SID 99 DIGEST, pp. 154-157, for example) was 0.65 or more. However, in the present example, the aperture ratio S2/S1 is selected to be in a range of from 0.1 to 0.4 for the purpose of improving the display contrast ratio, and as a result the reduction in display luminance is inevitable. To eliminate this problem, the present example optimizes the above-mentioned product pd. To facilitate the optimizing of the product pd, the present example adopts the ac vertical-discharge type in which two electrodes for generating a display discharge are disposed on two opposing substrates, respectively. As is clear from FIG. 28(*c*), higher display luminance can be obtained by selecting the product pd to be larger. Further, in the present example adopting the ac vertical-discharge type, since the product pd can be selected to be larger without being limited by the cell pitch of pixels as already explained, the distance d between the opposing electrodes is selected to be 0.2 mm or more, and the product pd is selected to be in a range of from 100 Torr×mm to 400 Torr×mm. The lower limit of the product pd is selected to secure display luminance at least approximately equal to that obtained by the conventional plasma display panels, and the upper limit of the product pd is selected to prevent the above-described sustain (display discharge) voltages Vs from becoming excessively higher (for example, 300 V). This example is capable of realizing a plasma panel having improved the light-room contrast and the luminous efficacy by employing the above-explained configuration satisfying the region hatched in FIG. 28(*c*).

Figure 29:
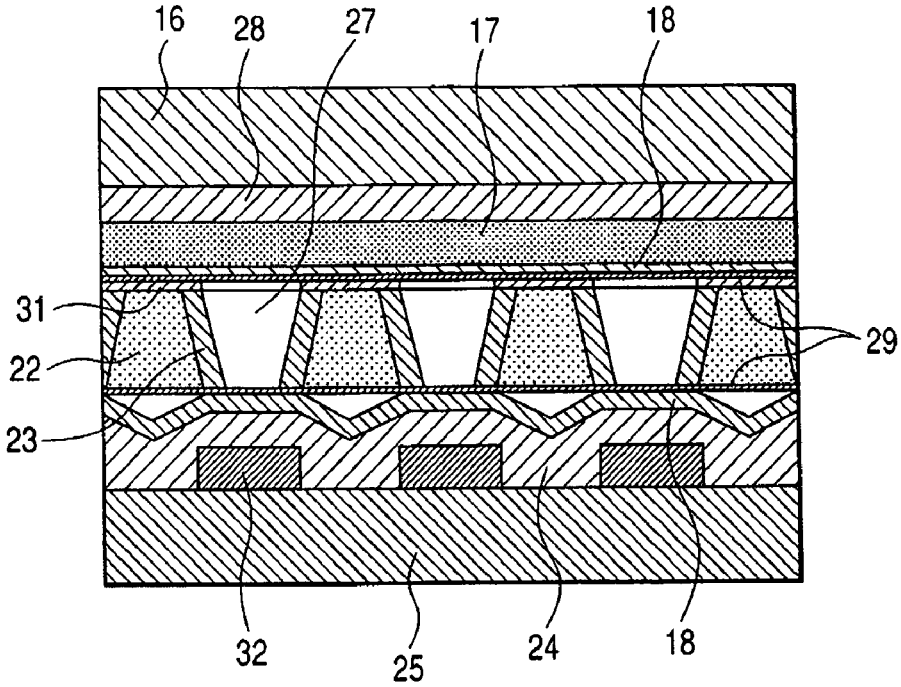
FIG. 29 is a cross-sectional view of the PDP of FIGS. 26(*a*) and 26(*b*) in the assembled state, taken along line V-V of FIGS. 26(*a*) and 26(*b*)

FIG. 29 is a cross-sectional view of the plasma display panel in the assembled state, taken along line V-V, viewed in the direction of the arrow b of FIGS. 26(*a*) and 26(*b*). The barrier rib plate 22 may be merely sandwiched between the front substrate 16 and the rear substrate 25, or the barrier rib plate 22 may be bonded between the front substrate 16 and the rear substrate 25 with heat-fusing layers 29 interposed therebetween.

EXAMPLE 12

Before explaining this example, the difference between the ac surface-discharge type plasma panel and the ac vertical-discharge type plasma panel will be explained by reference to FIGS. 30 to 33.

Figure 30:
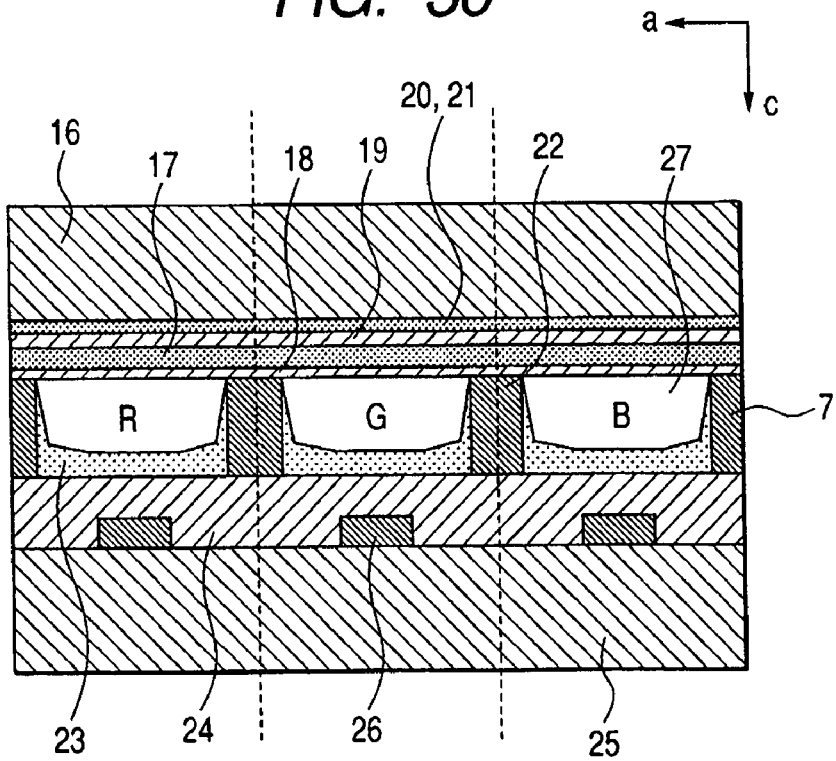
FIG. 30 is a cross-sectional view of one pixel in the structure of the ac surface-discharge type PDP.
Figure 31:
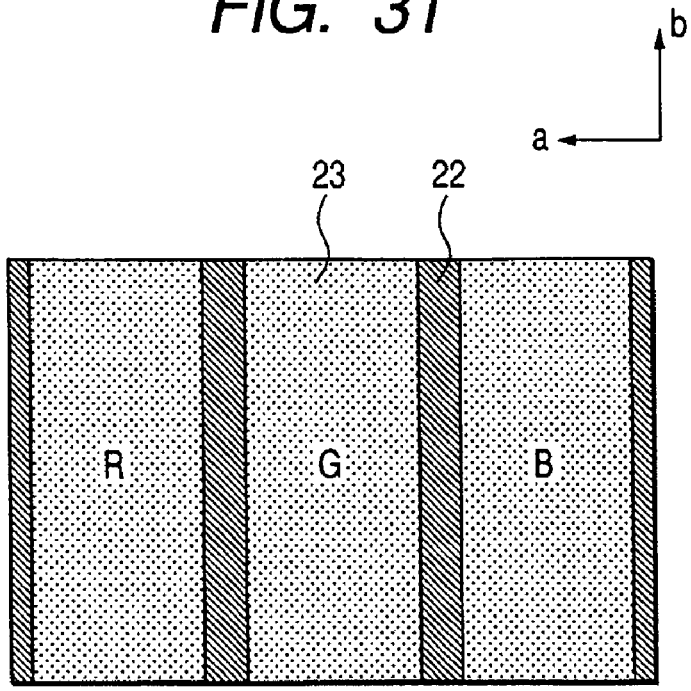
FIG. 31 is a plan view looking down at the PDP of FIG. 30.

FIG. 30 is a cross-sectional view of one pixel comprised of three discharge cells for three primary colors of red (R), green (G) and blue (B), respectively, in the ac surface-discharge type plasma panel. FIG. 31 is a plan view looking down at an arrangement of the barrier rib plate 22 and a two-layer structure 23 composed of a phosphor film and a reflection layer of the ac surface-discharge type plasma panel of FIG. 30.

Figure 32:
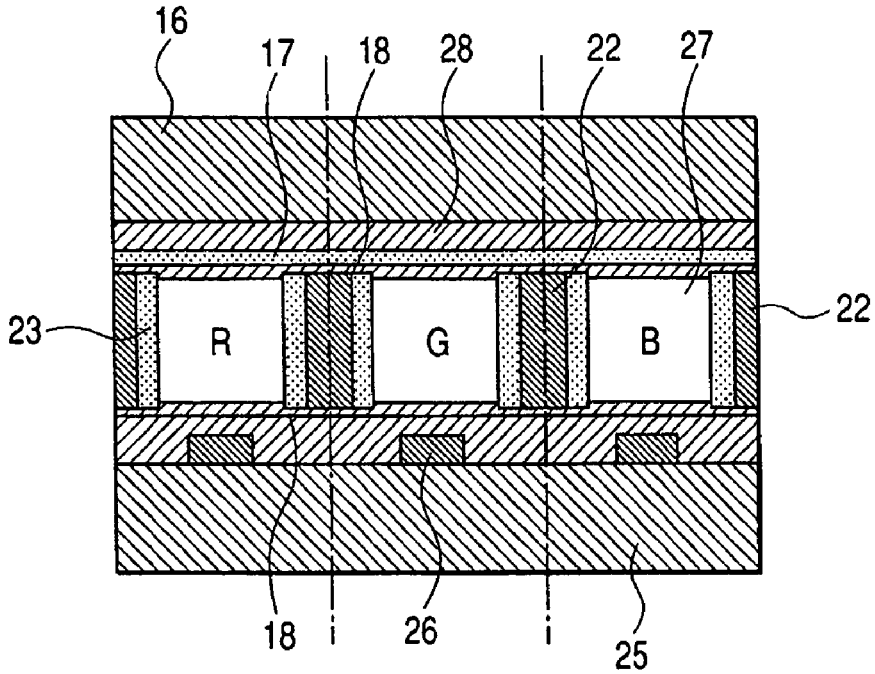
FIG. 32 is a cross-sectional view of one pixel in the structure of the ac vertical-discharge type PDP.
Figure 33:
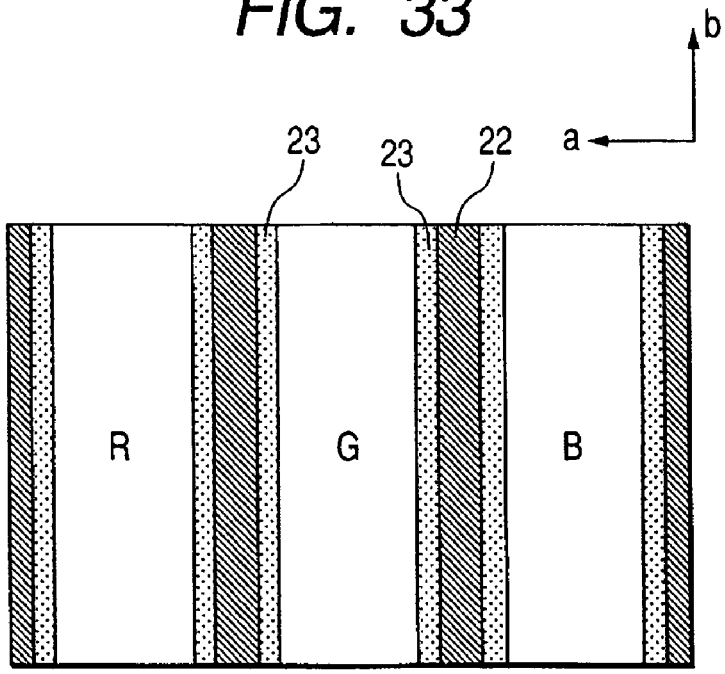
FIG. 33 is a plan view looking down at the PDP of FIG. 32.

FIG. 32 is a cross-sectional view of one pixel comprised of three discharge cells for three primary colors of red (R), green (G) and blue (B), respectively, in the ac vertical-discharge type plasma panel. FIG. 33 is a plan view looking down at an arrangement of the barrier rib plate 22 and a two-layer structure 23 composed of a phosphor film and a reflection layer of the ac vertical-discharge type plasma panel of FIG. 32. The ac vertical-discharge type plasma panel of FIG. 32 makes possible reduction of the areas occupied by the phosphors which appear white even when the discharges are not generated, and consequently, the ac vertical-discharge type plasma panel is capable of providing a higher light-room display contrast than that provided by the ac surface-discharge type plasma panel.

Figure 34:
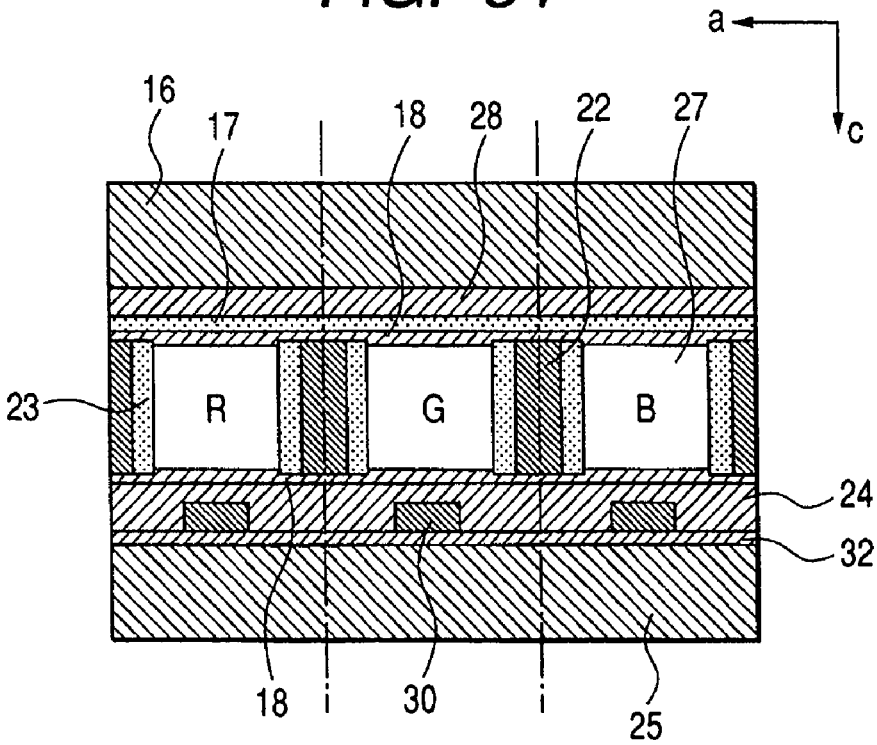
FIG. 34 is a cross-sectional view of an example of the structure of the ac vertical-discharge type PDP in accordance with another example of the present invention.
Figure 35:
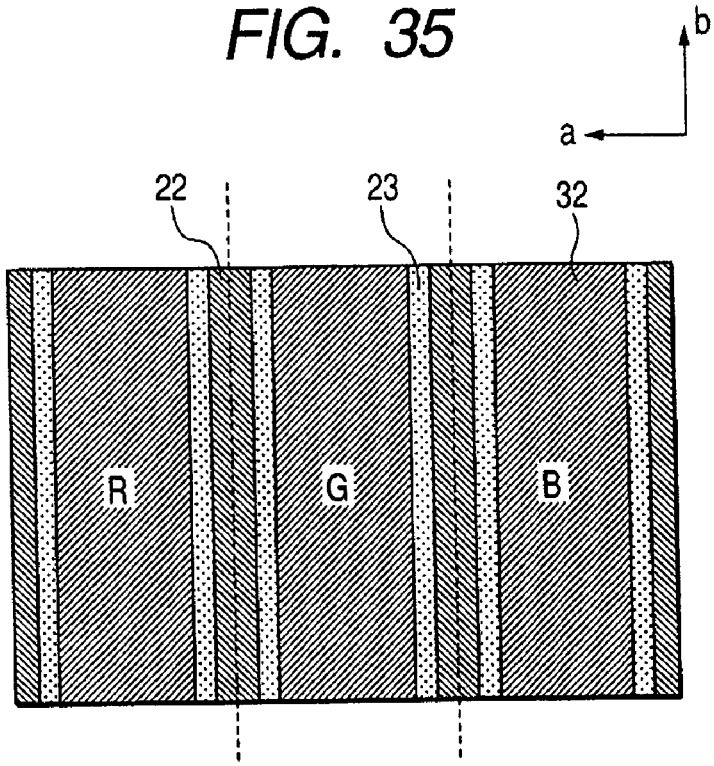
FIG. 35 is a plan view looking down at the PDP of FIG. 34.

FIG. 34 illustrates this example in accordance with the present invention, and is a cross-sectional view of the ac vertical-discharge type plasma panel provided with a visible-light non-reflection layer 32 on the rear substrate 25 and the data electrodes 30 within the discharge cells, visible from the viewing space for the purpose of improving the light-room display contrast when the discharge cells are not lit. The visible-light non-reflection layer 32 can be fabricated by mixing a dielectric material used for protection of the electrodes 30 with chromium or carbon. FIG. 35 is a plan view looking down at an arrangement of the barrier rib plate 22, the two-layer structure 23 composed of a phosphor film and a reflection layer phosphors 8 and the visible-light non-reflection layer 32 of the ac vertical-discharge type plasma panel of FIG. 34. In this case, the light-room display contrast is improved compared with the case illustrated in FIG. 33. Further, the display luminance and the luminous efficacy can be improved by employing an ultraviolet-ray and visible-light reflection layer instead of the visible-light non-reflection layer 32. The ultraviolet-ray and visible-light reflection layer can be fabricated by mixing a dielectric material with titanium, zinc or the like. Further, the display luminance and the luminous efficacy can also be further improved by disposing the ultraviolet-ray and visible-light reflection layer under the two-layer structure 23 composed of a phosphor film and a reflection layer (not shown, between the barrier rib plate 22 and the two-layer structure 23 composed of a phosphor film and a reflection layer).

Here, let a display discharge space boundary surface be a solid wall surrounding a display discharge space in which the ac vertical-discharge for display is generated. Let a discharge opening area be a portion of the display discharge space boundary surface through which display-forming visible light is irradiated into the outside of the front substrate. Let a non-opening area be the area of the display discharge space boundary surface other than the discharge opening area. Let a non-opening area reflectance be an average surface reflectance of the non-opening area to white light. The luminous efficacy was greatly improved by selecting the non-opening area reflectance to be 80% or more. Here, white light is visible light wavelengths of which range from 400 nm to 700 nm, the surface reflectances of the surfaces of the electrodes and the phosphors differ from each other, and therefore they are averaged.

Figure 36:
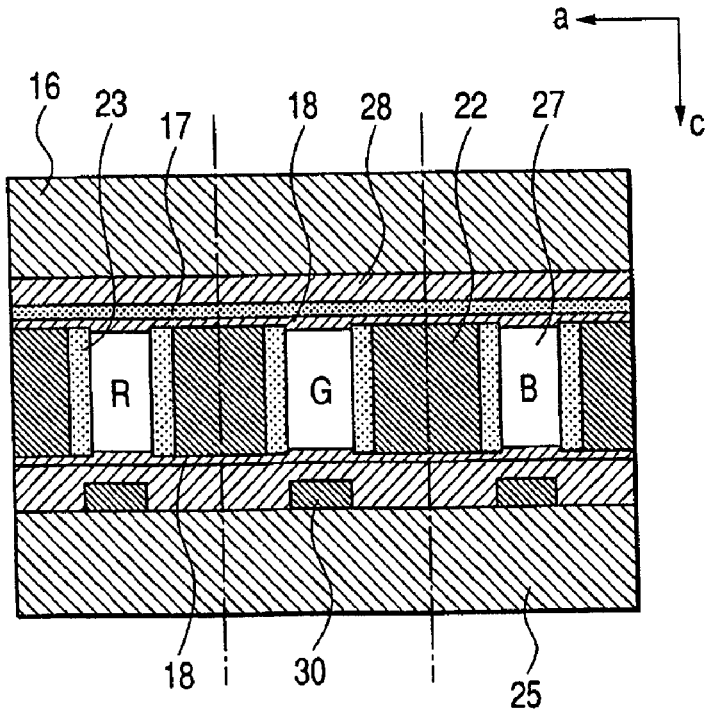
FIG. 36 is a cross-sectional view of an example of the structure of the ac vertical-discharge type PDP in accordance with still another example of the present invention.
Figure 37:
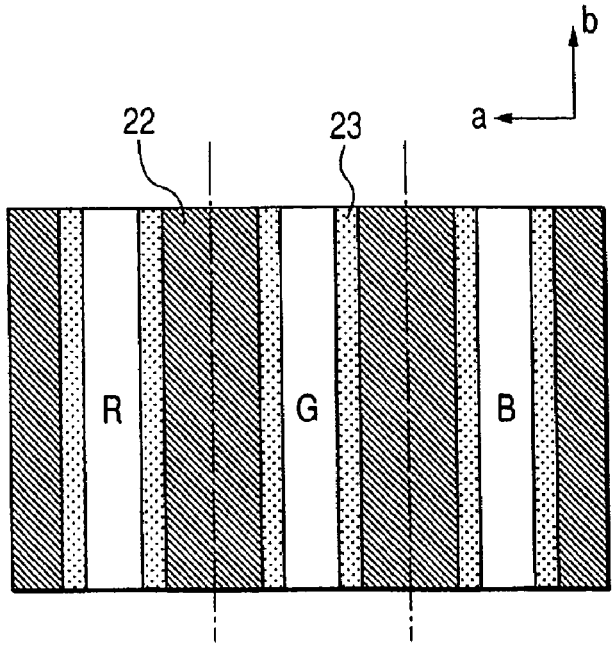
FIG. 37 is a plan view looking down at the PDP of FIG. 36.

FIGS. 36 and 37 illustrate an example which improves the light-room display contrast by selecting the width of the barrier rib plate 22 in cross section to be sufficiently large, and thereby reducing the aperture ratio. FIG. 36 is a cross-sectional view of an example of the ac vertical-discharge type PDP. In this case, although the discharge space is made smaller, since the distance between the scan electrodes 28 and the data electrodes 30 can be selected to be sufficiently large, this example is capable of providing luminance of generated light equal to or higher than that obtained by the ac surface-discharge type PDP. FIG. 37 is a plan view looking down at an arrangement of the barrier rib plate 22 and the two-layer structure 23 composed of a phosphor film and a reflection layer of the ac vertical-discharge type plasma panel of FIG. 36. In this case, the plasma panel having improved both the light-room display contrast and the luminous efficacy was realized by selecting the aperture ratio S2/S1 so as to satisfy the relationship $0.1<S2/S1<0.4$, and by satisfying the conditions indicated in FIG. 28(*c*).

EXAMPLE 13

Figure 38:
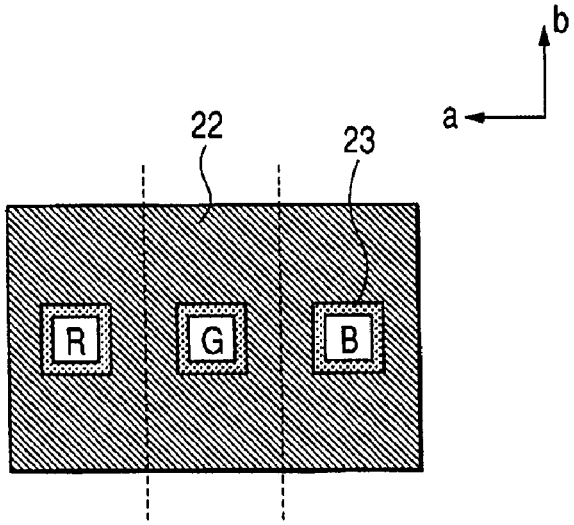
FIG. 38 is a plan view of an example of the structure of the ac vertical-discharge type PDP in accordance with still another example of the present invention.
Figure 39:
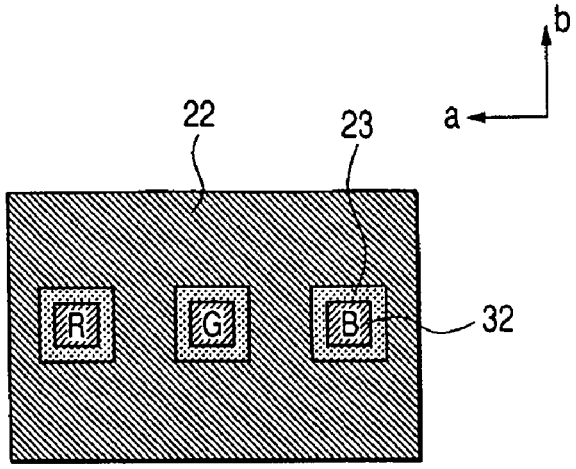
FIG. 39 is a plan view of an example of the structure of the ac vertical-discharge type PDP in accordance with still another example of the present invention.

Although the apertures provided in the barrier rib plate 22 are in the forms of stripes (or bands) in the examples explained in connection with FIGS. 32 to 37, the barrier rib plate 22 in the form of grids or boxes can also provides the same advantages. FIG. 38 is a plan view looking down at an example employing such a barrier rib plate. In this case, the aperture ratio can be made smaller, and the light-room display contrast can be improved. FIG. 39 is a plan view of an example of a plasma panel having disposed a visible-light non-reflection layer 32 on the surfaces of the front substrate 16 and the data electrodes 30 visible within the discharge cells from the viewing space in the case of FIG. 38.

EXAMPLE 14

Figure 40:
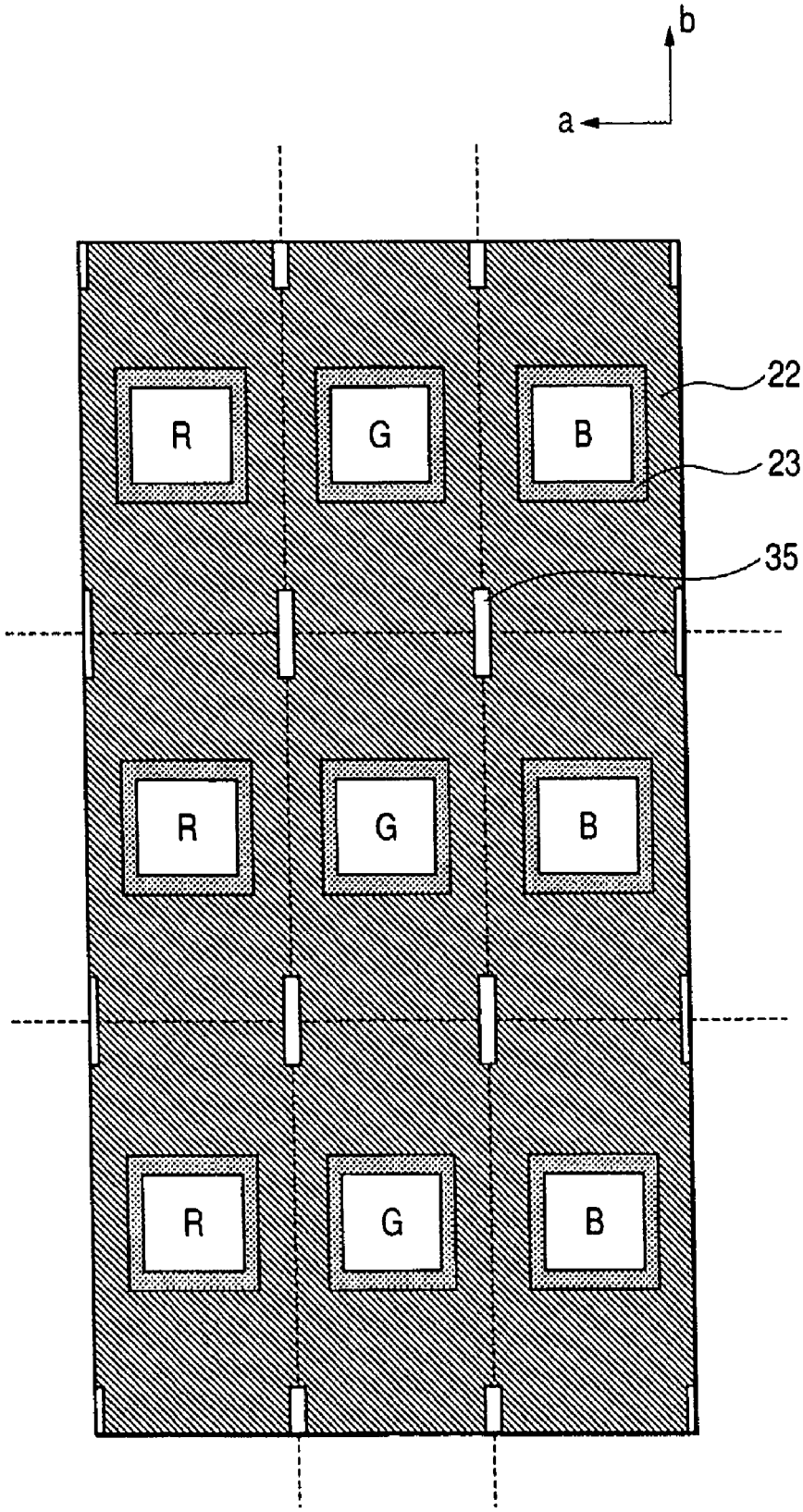
FIG. 40 is a plan view of an example of the structure of the ac vertical-discharge type PDP in accordance with still another example of the present invention.

The barrier rib plate 22 is subjected to stress during heat treatment in assembling of the plasma panel, and on rare occasions, the barrier rib plates 22, the front substrate 16 or the rear substrate 25 cracks. In such a case, if the coefficient of thermal expansion of material of the barrier rib plate 22 is adjusted to be 80% to 99% of those of the front substrate 16 and the rear substrate 25, the adjustment can prevent the cracking, and is useful for improving the yield rate. When slits 35 were made in the barrier rib plate 22 for the purpose of dispersing the stress, the cracking was prevented and the front substrate 16, the barrier rib plate 22 and the rear substrate 25 were stacked with higher precision. FIG. 40 illustrates the arrangement of the slits 35. The arrangement of the slits other than that shown in FIG. 40 has provided the same advantages.

Figure 41:
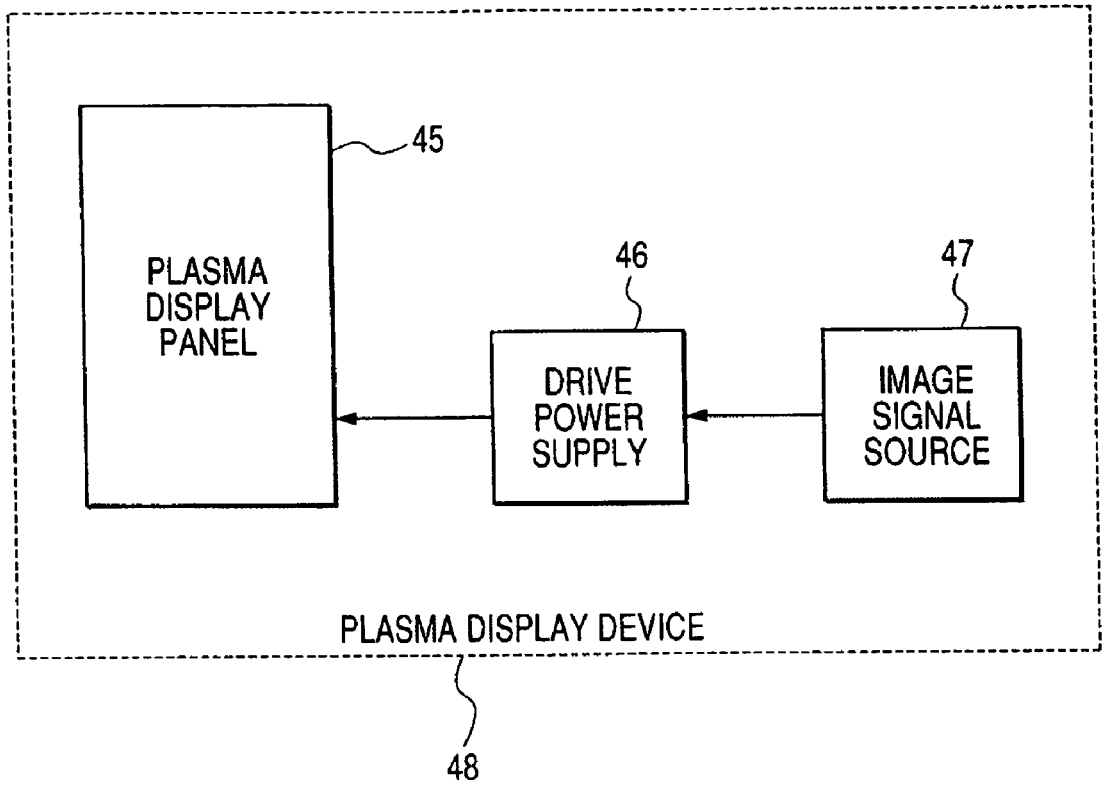
FIG. 41 is a block diagram illustrating a video display system employing the PDP of the present invention.

FIG. 41 illustrates an example of a video display system comprised of the plasma display device employing the PDP explained in the above examples of the present invention and an image signal source connected to the plasma display device. In FIG. 41, a drive power supply (also called a drive circuit) receives display signals from the image signal source, converts the display signals into drive signals for the PDP, and drives the PDP.

What is claimed is:

1. A plasma display panel comprising a plurality of discharge cells disposed between a pair of opposing first and second substrates, each of said plurality of discharge cells comprising at least: at least one pair of electrodes for generating a discharge for display; a discharge gas; and a phosphor film for emitting visible light by being excited by ultraviolet rays produced by said discharge of said discharge gas, wherein laminated members are dispersed throughout a plane to form multiple openings between adjacent laminated members in at least one cross-section perpendicular to said first and second substrates within each discharge cell of said plurality of discharge cells inside said first substrate from which visible light for display is emitted, each of said laminated members comprises a light absorption layer disposed on a side of said first substrate on which ambient light is incident and a light reflection layer disposed on a phosphor-film side of said each of said laminated members, wherein address electrodes are formed on said second substrate, said address electrodes are covered by a dielectric layer, and barrier ribs are formed on said dielectric layer, and wherein a visible-light-reflection layer is disposed on a surface of said dielectric layer and on a side surface of said barrier ribs, and said phosphor film is formed on said visible-light-reflection layer.

2. A plasma display panel according to claim 1, wherein said laminated members are integrally fabricated to form a unitary structure in said plane within each of said plurality of discharge cells and said unitary structure is perforated with plural openings passing light therethrough in said plane.

3. A plasma display panel according to claim 2, wherein said laminated members are fabricated in a pattern of one of a mesh and a ladder.

4. A plasma display panel according to claim 1, wherein said laminated members are plural in number in said plane within said each of said discharge cells, and are disposed separately from each other in said plane.

5. A plasma display panel according to claim 1, wherein at least one of said phosphor film and said visible-light-reflection layer is mixed with a pigment of approximately the same color as that of said visible light emitted by said phosphor film.

6. A plasma display device including at least a plasma display panel and a driving circuit which drives said plasma display panel, wherein said plasma display panel comprises a front substrate through which visible light for display is emitted and a plurality of discharge cells, each of said plurality of discharge cells is provided at least with electrodes for applying voltages to said each of said discharge cells, a discharge gas for generating discharge, a phosphor film which generates visible light based upon said discharge, and laminated members each comprised at least of a light absorption layer and a light reflection layer, and a visible-light-reflection layer disposed on a surface of said phosphor film on a side thereof opposite from a discharge space in which said discharge is generated, wherein said front substrate defines a part of said discharge space and forms part of a hermetic sealing, wherein a viewing space is defined as a space on a side of said front substrate opposite from said discharge space, a display surface is defined as a surface obtained by expanding over an entire area of each of said plurality of discharge cells a surface of said front substrate in contact with said discharge space, a portion of said visible light emitted into said viewing space through said display surface serves as said visible light for display, wherein a BM height hd is defined as an average of distances between a bottom surface of said discharge space and discharge-space-side surfaces of said laminated members, as measured perpendicularly to said display surface, where a first plane containing said laminated members is considered, and said bottom surface of said discharge space is a plane which faces said first plane across said discharge space and which bounds said discharge space, and wherein the following inequality is satisfied:

$$Lave/hd<5,$$

where a BM region is defined as a region occupied by said laminated members in said display surface, a light-transmissive region is defined as a region in said display surface through which said visible light from said discharge space is emitted into said viewing space, a length dbm-A is defined as a shortest distance between an arbitrary point A in said BM region and said light-transmissive region, and Lave is a value of said length dbm-A averaged over an entire area of said BM region with respect to said arbitrary point A.

7. A plasma display device according to claim 6, wherein said laminated members are fabricated in a pattern of one of (i) isolated islands, (ii) a mesh, (iii) a ladder, and (iv) branches of a tree.

8. A plasma display device according to claim 6, wherein said laminated members are disposed on or within said front substrate.

9. A plasma display device according to claim 6, wherein at least one of said phosphor film and said visible-light-reflection layer is mixed with a pigment of approximately the same color as that of said visible light emitted by said phosphor film.

10. A plasma display panel comprising a plurality of discharge cells disposed between a pair of opposing first and second substrates, each of said plurality of discharge cells comprising: at least one pair of electrodes for generating a discharge for display; a discharge gas; and a phosphor film for emitting visible light by being excited by ultraviolet rays produced by said discharge of said discharge gas, wherein laminated members are dispersed throughout a plane to form multiple openings between adjacent laminated members in at least one cross-section perpendicular to said first and second substrates within each discharge cell of said plurality of discharge cells inside said first substrate from which visible light for display is emitted, each of said laminated members comprises a light absorption layer disposed on a side of said first substrate on which ambient light is incident and a light reflection layer disposed on a phosphor-film side of said each of said laminated members, wherein address electrodes are formed on said second substrate, said address electrodes are covered by a dielectric layer, and barrier ribs are formed on said dielectric layer, wherein a visible-light-reflection layer is disposed on a surface of said dielectric layer and on a side surface of said barrier ribs, and said phosphor film is formed on said visible-light-reflection layer, and said visible-light-reflection layer is comprised of glass mixed with white oxide powders, and has a thickness in a range of from 10 μm to 20 μm.

11. A plasma display panel according to claim 10, wherein said white oxide powders are comprised of one of titanium oxide and zinc oxide.

12. A plasma display panel according to claim 10, wherein a proportion of said glass is in a range of from 40% by volume to 60% by volume of said visible-light-reflection layer.

13. A plasma display panel according to claim 10, wherein a thickness of said phosphor film overlying said visible-light-reflection layer is in a range of from 8 μm to 35 μm.

14. A plasma display panel according to claim 10, wherein at least one of said phosphor film and said visible-light-reflection layer is mixed with a pigment of approximately the same color as that of said visible light emitted by said phosphor film.

15. A plasma display panel including a plurality of discharge cells and a barrier rib layer which defines said plurality of discharge cells;

each of said plurality of discharge cells comprising:

two opposing electrodes disposed on inner surfaces of opposing front and rear substrates, respectively, for generating discharge between said front and rear substrates for forming a display;

dielectric films for covering said two opposing electrodes at least partially;

a discharge gas; and a phosphor film for generating visible light by being excited by ultraviolet rays produced by said discharge of said discharge gas, wherein said barrier rib layer is fabricated in a form of a sheet separate from said front and rear substrates, is provided with a plurality of openings each of which forms a discharge space in each of said plurality of discharge cells, with walls of said plurality of openings being coated with said phosphor film, and is sandwiched between said front and rear substrates, wherein a relationship of $0.1 \leqq (S1-S2)/S1 \leqq 0.4$ is satisfied, where S1 is an area of a projection of a space occupied by one of said plurality of discharge cells onto said front substrate,

S1−S2 is an area of a window portion of said front substrate through which the visible light is irradiated from said one of said plurality of discharge cells into an outside of said front substrate, wherein relationships of $100\ Torr \times mm \leqq pd \leqq 400\ Torr \times mm$ and $0.2\ mm \leqq d$ are satisfied, where p is a pressure of said discharge gas, and d is a distance between said two opposing electrodes, and wherein a visible-light-reflection layer is disposed on a surface of said phosphor film on a side thereof opposite from said discharge space in which said discharge is generated.

16. A plasma display panel according to claim 15, wherein said two opposing electrodes have applied therebetween a voltage of an effective value equal to or smaller than 300 V for sustaining said discharge for forming a display.

17. A plasma display panel according to claim 15, wherein said discharge gas contains a xenon gas, and a xenon proportion aXe in said discharge gas is in a range of from 0.12 to 0.3, where said xenon proportion aXe=nXe/ng, ng is a volume particle (atom or molecule) density of said discharge gas, and nXe is a volume particle density of said Xe gas.

18. A video display system employing said plasma display panel according to claim 15.

19. A plasma display panel according to claim 15, wherein at least one of said phosphor film and said visible-light-reflection layer is mixed with a pigment of approximately the same color as that of said visible light emitted by said phosphor film.

* * * * *